US012292230B2

(12) United States Patent
Gingras

(10) Patent No.: US 12,292,230 B2
(45) Date of Patent: May 6, 2025

(54) INSULATED PANEL STRUCTURE

(71) Applicant: SYSTEMES NORBEC INC., Boucherville (CA)

(72) Inventor: Jean-Pierre Gingras, Notre-Dame-de-la-Merci (CA)

( * ) Notice: Subject to any disclaimer, the term of this patent is extended or adjusted under 35 U.S.C. 154(b) by 0 days.

(21) Appl. No.: 18/157,143

(22) Filed: Jan. 20, 2023

(65) Prior Publication Data

US 2023/0235948 A1 Jul. 27, 2023

Related U.S. Application Data

(63) Continuation of application No. 17/122,551, filed on Dec. 15, 2020, now Pat. No. 11,614,272.
(Continued)

(51) Int. Cl.
*F25D 23/06* (2006.01)
*E04B 1/343* (2006.01)
(Continued)

(52) U.S. Cl.
CPC ..... *F25D 23/065* (2013.01); *E04B 1/388* (2023.08); *E04B 1/6179* (2013.01);
(Continued)

(58) Field of Classification Search
CPC ..... E04B 1/6183; E04B 1/34321; E04B 1/40; E04B 1/61; E04B 1/6104; E04B 1/6116; E04B 1/6179; E04B 2001/6191; E04B 2001/6195; E04B 1/388; E04C 2002/004; E04C 2/292; F25D 23/063; F25D 23/065; Y10T 29/49629
See application file for complete search history.

(56) References Cited

U.S. PATENT DOCUMENTS 2,065,525 A 12/1936 Hamilton
2,129,975 A 9/1938 Urbain
(Continued)

FOREIGN PATENT DOCUMENTS

DE 29919825 U1 1/2000
EP 0887482 A1 12/1998

OTHER PUBLICATIONS

Corresponding European application No. 08016958.4 the examination report dated Apr. 23, 2013.
(Continued)

*Primary Examiner* — Matthew P Travers
(74) *Attorney, Agent, or Firm* — Anglehart et al.

(57) ABSTRACT

A method of manufacturing a kit for a cold storage room includes the following steps: determining one or more dimensions of the cold storage room; providing continuously manufactured insulation panels, cut to have a length based on the dimensions of the cold storage room, and having alignment structures formed thereon; cutting one or more of the continuously manufactured insulation panels to have a width based on the dimensions of the cold storage room and to form one or more joints; forming connecting structures on one or more of the continuously manufactured insulation panels, the connecting structures configured to form one or more joints; and providing connection hardware configured to mate with the connecting structures and to form one or more joints.

16 Claims, 28 Drawing Sheets

Related U.S. Application Data

(60) Provisional application No. 63/015,060, filed on Apr. 24, 2020.

(51) Int. Cl.

| | |
|---|---|
| ***E04B 1/38*** | (2006.01) |
| ***E04B 1/61*** | (2006.01) |
| ***E04C 2/00*** | (2006.01) |
| ***E04C 2/292*** | (2006.01) |

(52) U.S. Cl.

CPC ..... *E04B 1/6183* (2013.01); *E04C 2/292* (2013.01); *E04B 1/34321* (2013.01); *E04B 2001/6195* (2013.01); *E04C 2002/004* (2013.01)

(56) References Cited

U.S. PATENT DOCUMENTS

| | | | |
|---|---|---|---|
| 3,196,499 | A | 7/1965 | Houvener |
| 3,327,447 | A | 6/1967 | Nissley |
| 3,341,233 | A | 9/1967 | Cushman |
| 4,417,430 | A | 11/1983 | Loikitz |
| 5,373,678 | A | 12/1994 | Hesser |
| 5,490,361 | A | 2/1996 | Gingras |
| 5,509,242 | A | 4/1996 | Rechsteiner et al. |
| 6,119,427 | A | 9/2000 | Wyman et al. |
| 6,299,224 | B1 | 10/2001 | Finkelstein |
| 6,763,643 | B1 | 7/2004 | Mårtensson |
| 8,161,706 | B2 | 4/2012 | Gingras |
| 8,776,472 | B1 * | 7/2014 | Kinser, Jr. ..... E04B 1/80 52/584.1 |
| 2008/0271402 | A1 | 11/2008 | Gingras |
| 2009/0223161 | A1 | 9/2009 | Segall |
| 2011/0209429 | A1 | 9/2011 | Gingras |
| 2012/0060349 | A1 | 3/2012 | Williams |
| 2014/0196867 | A1 | 7/2014 | Tarraga Sánchez et al. |

OTHER PUBLICATIONS

Corresponding European application No. 08016958.4 the examination report dated Feb. 16, 2015.

Corresponding European application No. 08016958.4 the extended European search report dated Mar. 11, 2009.

Corresponding Canadian patent application No. 3102712 Office Action dated May 25, 2021.

Corresponding Canadian patent application No. 3102712 Office Action dated Jun. 6, 2022.

* cited by examiner

INSULATED PANEL STRUCTURE

CROSS-REFERENCE TO RELATED APPLICATIONS

This application is a continuation application of U.S. patent application Ser. No. 17/122,551, filed Dec. 15, 2020, now allowed, which, in turn, claims priority from U.S. provisional patent application 63/015,060 filed on Apr. 24, 2020, the contents of which are hereby incorporated by reference.

TECHNICAL FIELD

This application relates to structures made from insulated panels and also to associated hardware for connecting insulated panels.

BACKGROUND

Cold storage rooms are used to hold food, laboratory samples, and other items that must be kept at a refrigerated temperature. They often provide the space necessary to store a large quantity of items. For example, a supermarket may use a cold storage room to store produce, dairy products, and any other food that must be refrigerated before the food is displayed for sale. Cold storage rooms are often constructed by adding insulation panels to the inside of an existing structure. Therefore, there is significant interest in insulation panels designed to fit inside specified existing structures and to connect to each other to form an airtight structure with good insulative properties.

Current methods and systems meet this need by providing custom molded insulated panels which can be assembled into a cold storage room within a specified structure. Each panel may be molded to a desired size based on the overall size of the cold storage room. During the molding process, connection elements may be inserted within and/or bonded to the insulated panels.

These systems and methods present several shortcomings. First, custom molding is a time-consuming, expensive, and labor-intensive process because each panel must be molded individually, and the molds must be reset to produce panels of different sizes. Second, is the insulation provided by custom molded panels may be less even than that provided by continuously manufactured insulation panels. Third, the connection elements must be added to the panels during the manufacturing process, which provides little flexibility for later modifications. Fourth, the connection elements are embedded in the foam of the panels, providing a relatively weak connection. Specifically, the foam holding a connection element in place may be damaged when the connection element is used to form a connection or when a load is applied to the connection. Accordingly, custom molded insulated panels are expensive and time-consuming to produce, do not provide optimum insulation, and are susceptible to failure at connections between panels.

SUMMARY

Based on the shortcomings of existing systems and methods for constructing cold storage rooms, there exists a need for systems and methods which enable more efficient manufacture, allowing a much more automated process, for manufacturing a cold storage room and provide a cold storage room with good insulative properties and robust connections. The present disclosure relates to systems and methods that meet these needs.

In some aspects, the present disclosure relates to a cold storage room and associated methods, systems, and devices. These may include kits for constructing a cold storage room, a method of manufacturing a kit for constructing a cold storage room, and a method of assembling a cold storage room. Such embodiments may allow for a cold storage room with good insulative properties that can be quickly and inexpensively manufactured and assembled.

In some aspects, the present disclosure relates to hardware and methods for joining panels at in-line wall-to-wall joints, corner wall-to-wall joints, floor-to-wall joints, and ceiling-to-wall joints. In some embodiments, hardware and methods according to the present disclosure may be used to join insulation panels in the construction of a cold storage room. However, the joints disclosed herein may also be used to join other types of panels in other applications.

Specifically, in one aspect, the present disclosure relates to a method of manufacturing a kit for a cold storage room that could be entirely automated. The method may include the following steps: determining one or more dimensions of the cold storage room; providing continuously manufactured insulation panels, cut to have a length based on the dimensions of the cold storage room, and having alignment structures formed thereon; cutting one or more of the continuously manufactured insulation panels to have a width based on the dimensions of the cold storage room and to form one or more joints; forming connecting structures on one or more of the continuously manufactured insulation panels, the connecting structures configured to form one or more joints; and installing connection hardware on one or more of the continuously manufactured insulation panels, the connection hardware configured to form one or more joints.

Other aspects and embodiments of the present disclosure will be described below.

Advantages of the present disclosure will be apparent throughout the description.

DETAILED DESCRIPTION

In general, the present disclosure relates to a cold storage room and associated methods, systems, and devices. Some embodiments of the present disclosure are directed to hardware and methods for joining panels at in-line wall-to-wall joints, corner wall-to-wall joints, floor-to-wall joints, and ceiling-to-wall joints. In some embodiments, hardware and methods according to the present disclosure may be used to join insulation panels in the construction of a cold storage room. Further embodiments of the present disclosure are directed to a cold storage room, kit for constructing a cold storage room, a method of manufacturing a kit for constructing a cold storage room, and a method of assembling a cold storage room.

A cold storage room or locker is typically an indoor enclosure provided with refrigeration for the storage of foods or beverages. The embodiments set out herein may also be applicable to building outdoor insulated structures, such as a garage, a clean room, a server room, or a grow chamber, in addition to indoor rooms other than a cold storage room benefitting from the thermal and/or acoustic insulation.

Cold Storage Room Overview

One or more embodiments of the present disclosure relates to a cold storage room and/or components thereof. The cold storage room may be constructed of insulated panels, which may be joined to each other via a variety of types of joints. Examples of the panels, joints, and overall configuration of the cold storage room are described in detail below. A cold storage room in accordance with the present disclosure may include some or all of the features described below. The cold storage room may also include features not described below in conjunction with some or all of the features described below.

Figure 1A:
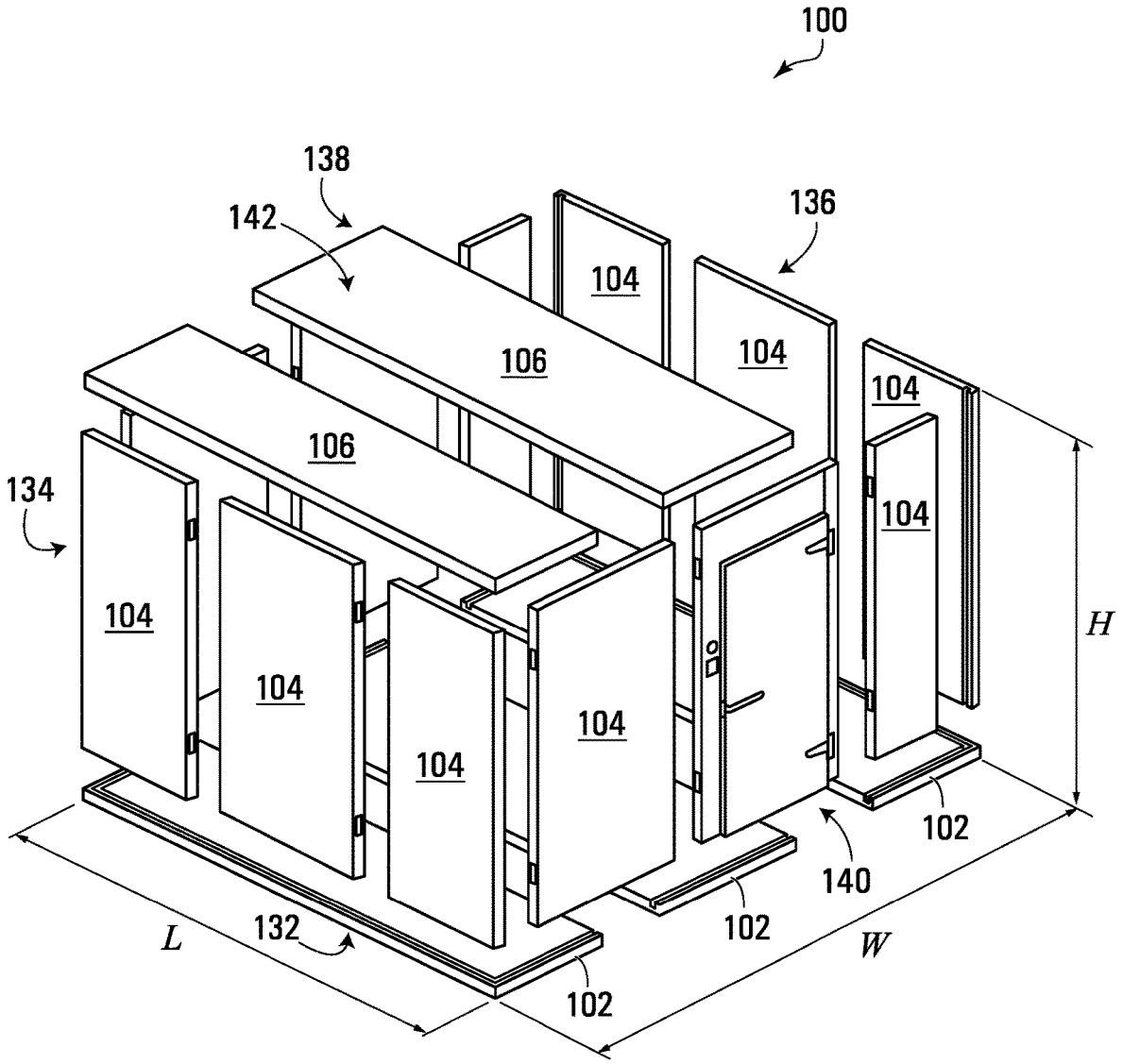
FIG. 1A is a cold storage room according to the present disclosure.

FIG. 1A illustrates a cold storage room 100. The cold storage room 100 may have a floor 132, four walls 134, 136, 138, 140, and a ceiling 142. Two of the walls 134, 136 may extend in a length direction and two of the walls 138, 140 may extend in a width direction. (See length "L" and width "W" in FIG. 1A.) The walls 134, 136 extending in the length direction may or may not be structurally identical to the walls 138, 140 extending in the width direction.

The floor may be made up of one or more floor panels 102. Each of the walls 134, 136, 138, 140 may be made up of one or more wall panels 104. The ceiling 142 may be made up of one or more ceiling panels 106. The panels 102, 104, 106 may be insulated panels. A cold storage room 100 may include any number of floor panels 102, wall panels 104, and ceiling panels 106. The exemplary embodiment illustrated in FIG. 1A includes three panels in each of the walls 134, 136, 138, 140, and in the floor 132 and the ceiling 142. Based on this illustration, one can readily envision a cold storage room 100 including any number of panels in each wall, and in the floor and ceiling.

In some embodiments, the panels 102, 104 and 106 are of the same construction and material. Using the same panels can simplify manufacture of the components to be assembled as the insulated structure. However, it will be appreciated that for a deep freeze cold storage room, good insulation at the floor and every wall and at the ceiling is important, while for a refrigerated room held above freezing, the floor insulation can be reduced or eliminated depending on the needs.

Figure 2A:
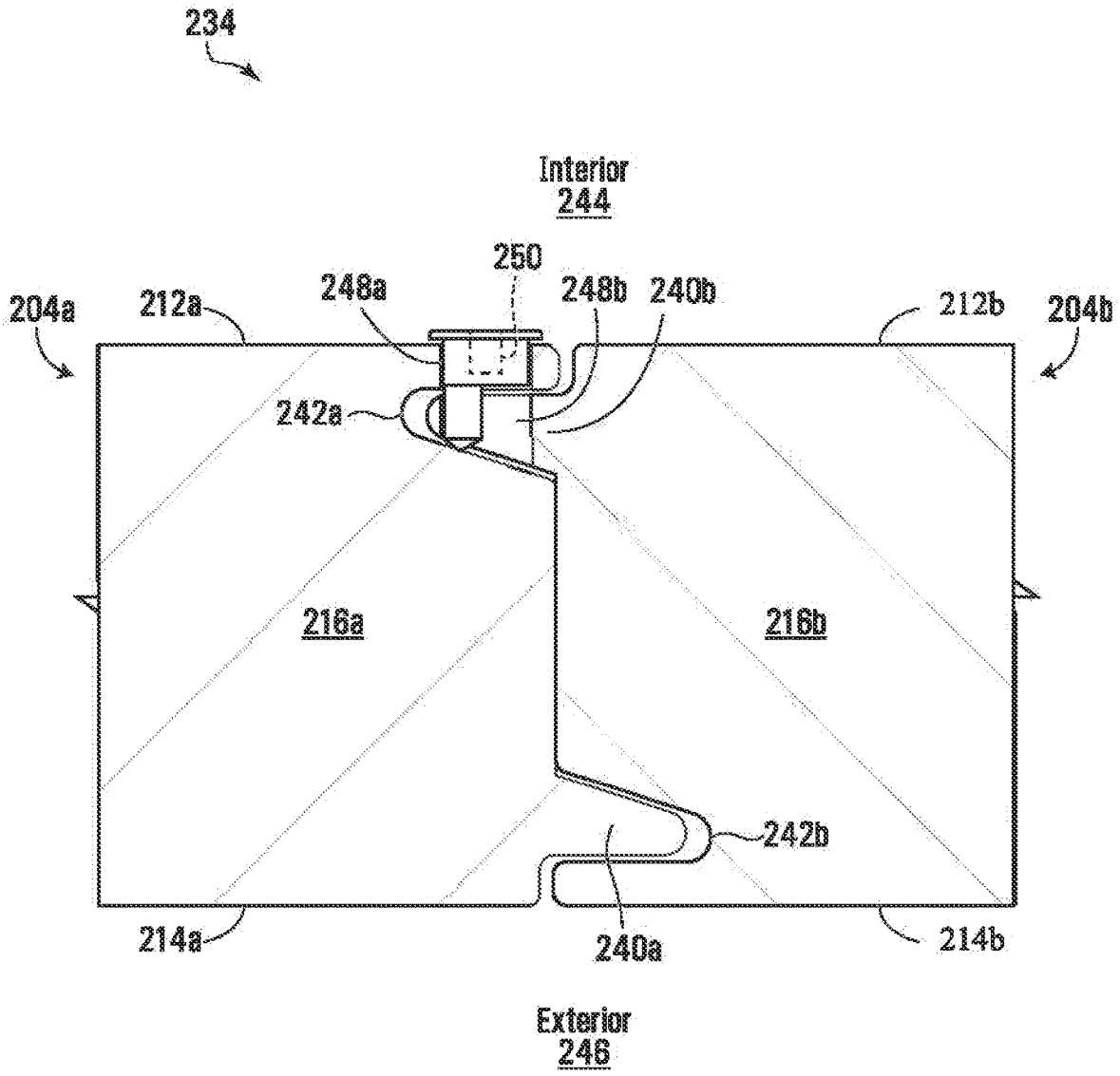
FIGS. 2A-2C are an in-line wall-to-wall joint and components thereof according to the present disclosure.

The panels 102, 104, 106 may be joined to each other via joints illustrated in FIG. 2A. The joints may include one or more of the following elements: alignment structures formed on the panels 102, 104, 106, which align, but do not lock with adjacent panels 102, 104, 106; connection structures formed on the panels 102, 104, 106, which lock with adjacent panels; and connection hardware which interacts with the connection structures.

The cold storage room 100 may have a length "L," a height "H," and a width "W." The length "L," the height "H," and the width "W" may be chosen based on a variety of factors. For example, a cold storage room 100 may be designed to fit within an existing structure: the length "L," the height "H," and the width "W" may be selected based on the interior dimensions of the structure. In some embodiments, a cold storage room 100 may be designed to contain a certain volume and configuration of material or may be designed to be mass-produced in particular sizes. In some embodiments, a cold storage room 100 may be a free-standing structure.

Insulated Panels

Figure 1B:
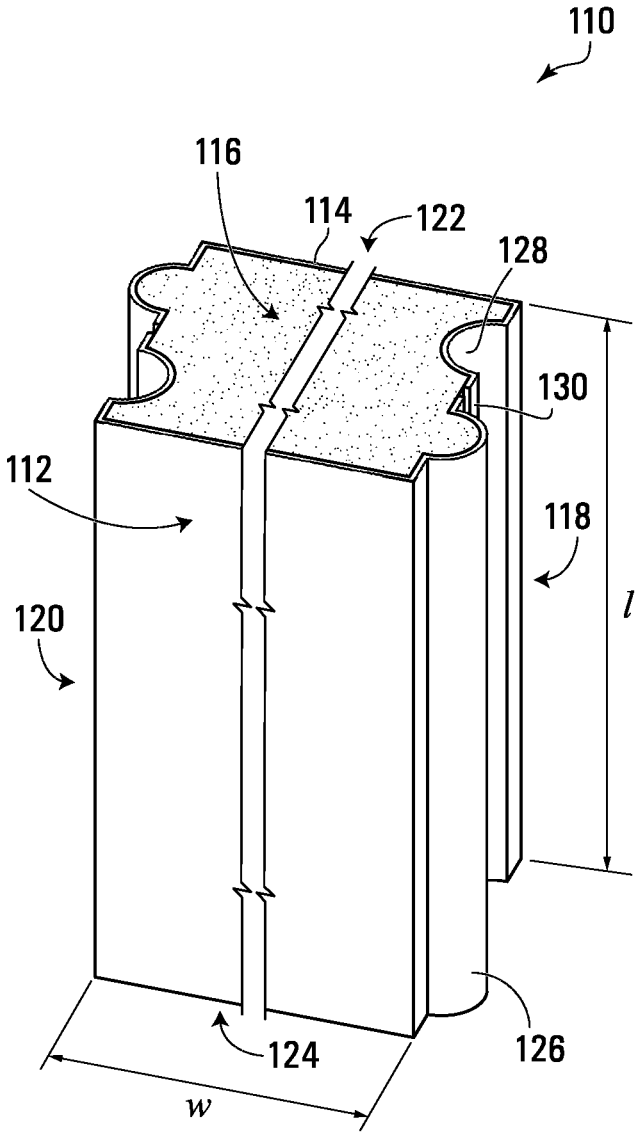
FIG. 1B is an insulated panel according to the present disclosure.

FIG. 1B illustrates a generic insulated panel 110. Such an insulated panel 110 may be used as a floor panel 102, a wall panel 104, or a ceiling panel 106 in a cold storage room 100. In some embodiments, modifications may be made to the insulated panel 110 as it is illustrated in FIG. 1B before it is used as a floor panel 102, a wall panel 104, or a ceiling panel 106.

The insulated panel 110 may comprise an interior metal sheet 112, an exterior metal sheet 114, and a layer of foam 116 disposed between the metal sheets 112, 114. The metal sheets 112, 114 may be steel or another sheet metal material. Non-metal sheet material whether plastic, fiberboard, bamboo fiber sheet material, can also be suitable depending on the needs for strength, fire resistance and easy to clean surface properties. The foam layer 116 may be polyurethane or other suitable foam insulation material. The specific materials used in an insulated panel 110 may be chosen based on desired properties of the insulated panels and/or the equipment with which the insulated panel 110 is manufactured.

An insulated panel 110 may have four edges: a first uncut edge 118, a second uncut edge 120, a first cut edge 122, and a second cut edge 124. The edges are identified as cut and uncut based on an exemplary manufacturing process described below, but this nomenclature should not be understood to limit the manner in which any edge may be formed. Alignment structures may be formed on the uncut edges 118, 120 of the insulated panel 110. Complementary alignment structures may be formed on the first uncut edge 118 and the second uncut edge 120, such that the first uncut edge 118 of one insulated panel 110 can mate with the second uncut edge 120 of another insulated panel 110. (See FIG. 2A for an example of complementary alignment structures.)

In some embodiments, as shown in FIG. 1B, the alignment structures may comprise a tongue 126, a groove 128, and a gap 130 extending between the tongue 126 and the groove 128. The overall structure of the edge on which the alignment structures are formed may be an S-curve, a Z-curve, or some other formation. The interior metal sheet 112 may extend around the tongue 126 and into the foam layer 116. In some embodiments, the interior metal sheet 112 may be secured to the tongue 126, for example, by adhesive. The exterior metal sheet 114 may extend over the groove 128 and may or may not extend over part of the gap 130. The foam layer 116 may be exposed over part or all of the gap 130. The tongue 126, the groove 128, and the gap 130 may extend along the entire uncut edge or some portion of the uncut edge 118, 120.

In some embodiments, different alignment structures (not shown) may be formed on the uncut edges of an insulated panel. For example, a single groove may be formed on the first uncut edge of an insulated panel and a single complementary tongue may be formed on the second uncut edge. Alignment structures may also include pegs, holes, or other structures that do not extend over an entire uncut edge.

Manufacture of Insulated Panels

The insulated panel 110 may be manufactured by a continuous, fully automated process. Two continuous metal sheets having the same width may be manufactured; later in the process, these sheets will form the interior metal sheet 112 and exterior metal sheet 114. The two sheets may enter a panel press which may maintain them at a constant width from each other. The panel press may also roll or otherwise form the edges of the metal sheets to form the alignment structures described above. The sheet material can then be conveyed with a suitable gap or space between the sheets. Foam may be injected into the space between the sheets, and the foam may expand and bond to both metal sheets. Foam expansion can increase the space between the sheets and lateral guides can contain the foam at sides 118 and 120 between the sheets 112 and 114 as the foam expands and begins to set. The assembly of the metal sheets and foam may be cut into panels 110 of any length "1" in a continuous process. The cutting may be performed by an automated saw or any other equipment known in the art. Accordingly, an insulated panel 110 formed by such a process may have a width "w" determined by the manufacturing process and a length "1" which may be chosen by the manufacturers. In the case of a plastic or fiber composite sheet material for the sheets 112, 114, a continuous process such as extrusion for producing and feeding the sheet material can be used.

As can be seen in FIG. 1A, the length "1" of the wall panels 104 determines the height "H" of the cold storage room 100. Similarly, the length "1" of the ceiling panels 106 and the floor panels 102 determines the length "L" of the cold storage room 100. In the illustrated embodiment, the width "W" of the cold storage room 100 is not determined by the length "1" of any of the insulated panels. However, one can readily envision an embodiment in which the floor panels 102, the ceiling panels 106, or both are rotated 90 degrees, such that the width "W" of the cold storage room 100 is determined by the length "1" of at least one of the floor panels 102 and the ceiling panels 106. Accordingly, an insulated panel 110 may be cut to a length "1" determined based on the intended length "L," width "W," or height "H" of the cold storage room 100 in which the insulated panel 110 will be used.

One skilled in the art will recognize that these steps need not be performed in the prescribed order. For example, insulated panels having alignment structures may be acquired, and then cut to a desired length "1." For another example, alignment structures may be formed as a last step on insulated panels manufactured using a panel press that cannot roll the edges of the sheet metal. Such modifications may allow off-the-shelf insulated panels to be used to construct a custom-designed cold storage room.

Modification of Insulated Panels

Insulated panels manufactured according to the process described above may be modified to have a desired width and to include connecting features which allow each panel to be joined to adjacent panels in a cold storage room or other structure.

As can be seen in FIG. 1A, the number of wall panels 104 used in the walls 134, 136 extending in the length direction grossly determines the length "L" of the cold storage room 100. Similarly, the number of wall panels 104 used in the walls 138, 140 extending in the width direction, the number of floor panels 102 used in the floor 130, and the number of ceiling panels 106 used in the ceiling 142 grossly determines the width "W" of the cold storage room 100.

Finer control of the length "L" may be achieved by controlling the width "w" of one or more of the wall panels 104 which make up the walls 134, 136 extending in the length direction. Finer control of the width "W" may be achieved by controlling the width "w" of one or more of the wall panels 104 which make up the walls 138, 140 extending in the width direction, one or more of the floor panels 102, and one or more of the ceiling panels 106. Controlling the width "w" of a panel 102, 104, 106 may comprise cutting the panel 102, 104, 106 parallel to its uncut edges 118, 120. The two wall panels 104 which form the ends of each wall 134, 136, 138, 140 may be cut, while the medial wall panels 104 may not be cut. The two floor panels 102 which form the ends of the floor 132 may be cut, while the medial floor panels 102 may not be cut. The two ceiling panels 106 which form the ends of the ceiling 142 may be cut, while the medial ceiling panels 106 may not be cut.

Waste of insulated panels 110 may be minimized when a cold storage room 100 is constructed. A single insulated panel 110 may be cut to form two panels for a cold storage room 100. These panels may be floor panels 102, wall panels 104, and/or ceiling panels 106. The two panels may or may not be the same type of panel 102, 104, 106. For example, an insulated panel 110 may have a width "w" of forty-four inches. This insulated panel 110 may be cut in the length "1" direction to form a first wall panel 104 having a width "w" of twelve inches and a second wall panel 104 having a width "w" of twenty-eight inches. The remaining four inches of the insulated panel 110 may be discarded. This significantly reduces the waste of insulated material compared to what would be wasted if two insulated panels 110 were cut to form the first wall panel 104 and the second wall panel 104.

The profile of the cut edge may be chosen such that the panel may align with an adjacent panel when the cold storage room is assembled. The specific profile used may be determined by a panel's function as a floor panel, a wall panel, or a ceiling panel. Exemplary cut profiles which may be made on each type of panel are described in detail below.

Further modifications may be made to the insulated panels to enable it to be joined to other insulated panels. Wall panels may be modified to form in-line and/or corner wall-to-wall joints, wall-to-floor joints, and/or wall-to-ceiling joints. Floor panels may be modified to form stronger floor-to-floor joints and/or wall-to-floor joints. Ceiling panels may be modified to form wall-to-ceiling joints. Each of these joint types will be discussed in detail below.

When the insulated panels have a sheet steel cladding, a metal saw can be used to cut the sheet material on opposite sides first with the foam being cut by hot wire. Alternatively, a single cut can be used, for example using a larger circular blade, bandsaw or reciprocal saw. Laser cutting can also be used, if desired.

In some embodiments, insulated panels may be modified at the same facility at which they are manufactured. Manufacture and modification of the insulated panels may be part of a single process, which may be partially or entirely automated. In some embodiments, insulated panels may be modified at a different facility than the one at which they are manufactured. In such embodiments, manufacture and modification of the insulated panels may be two separate processes. The modification process may or may not be automated.

In-Line Wall-to-Wall Joint

Adjacent wall panels which belong to the same wall may be connected to each other at an in-line wall-to-wall joint.

Figure 2B:
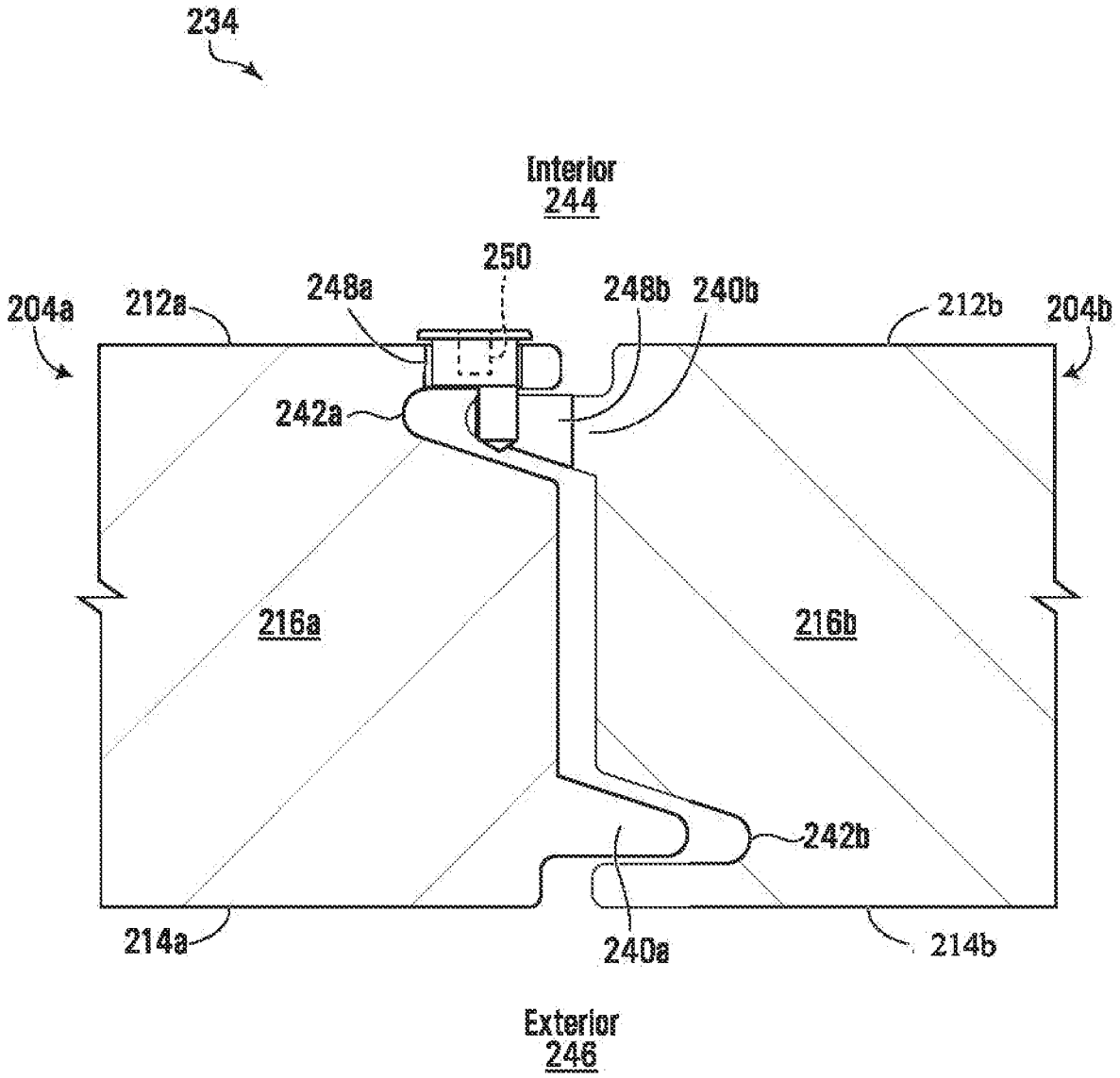

FIGS. 2A-2B illustrate an in-line wall-to-wall joint connecting a first wall panel 204*a* and a second wall panel 204*b*. The wall panels 204*a*, 204*b* may abut each other along a single wall 234 of a cold storage room. The wall 234 may have an interior side 244 and an exterior side 246. With reference to FIG. 2A, the wall 234 may extend in either a length direction or a width direction. FIG. 2A illustrates the wall panels 204*a*, 204*b* in a locked configuration; FIG. 2B illustrates the wall panels 204*a*, 204*b* in an unlocked configuration.

Figure 3A:
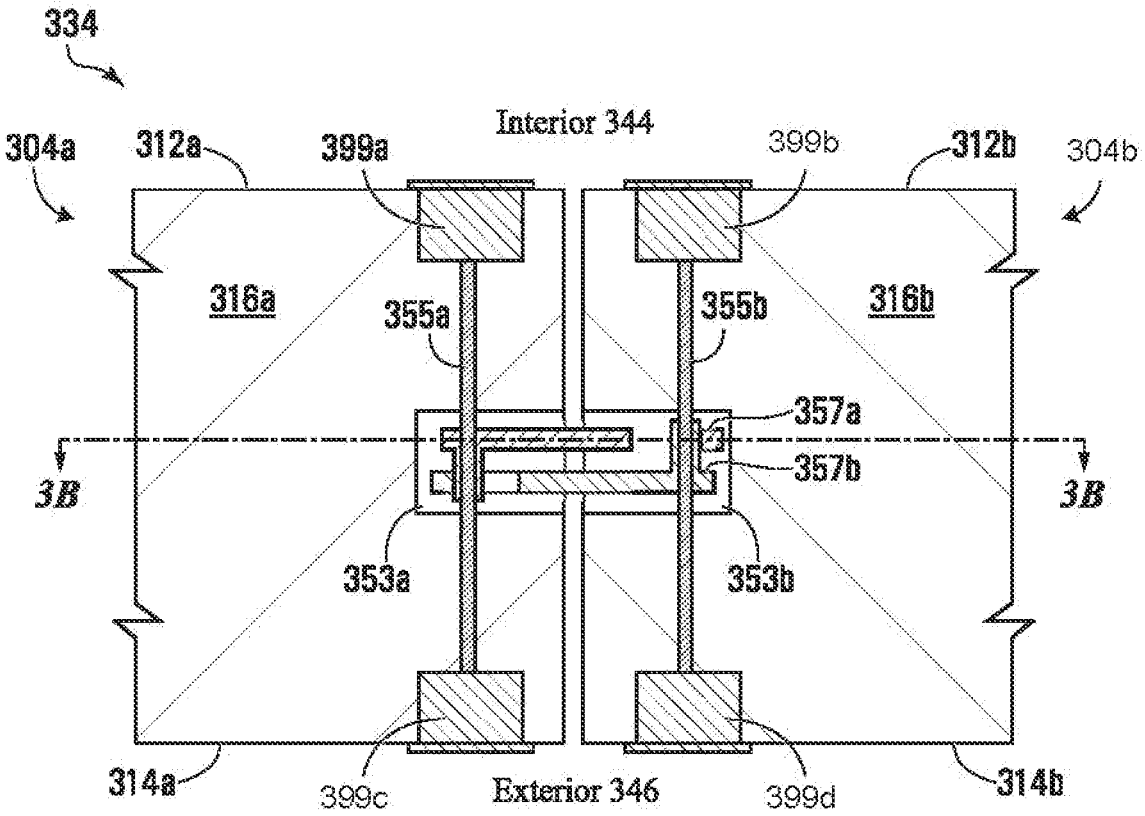
FIG. 3A-3B are an in-line wall-to-wall joint in accordance with the present disclosure.
Figure 3B:
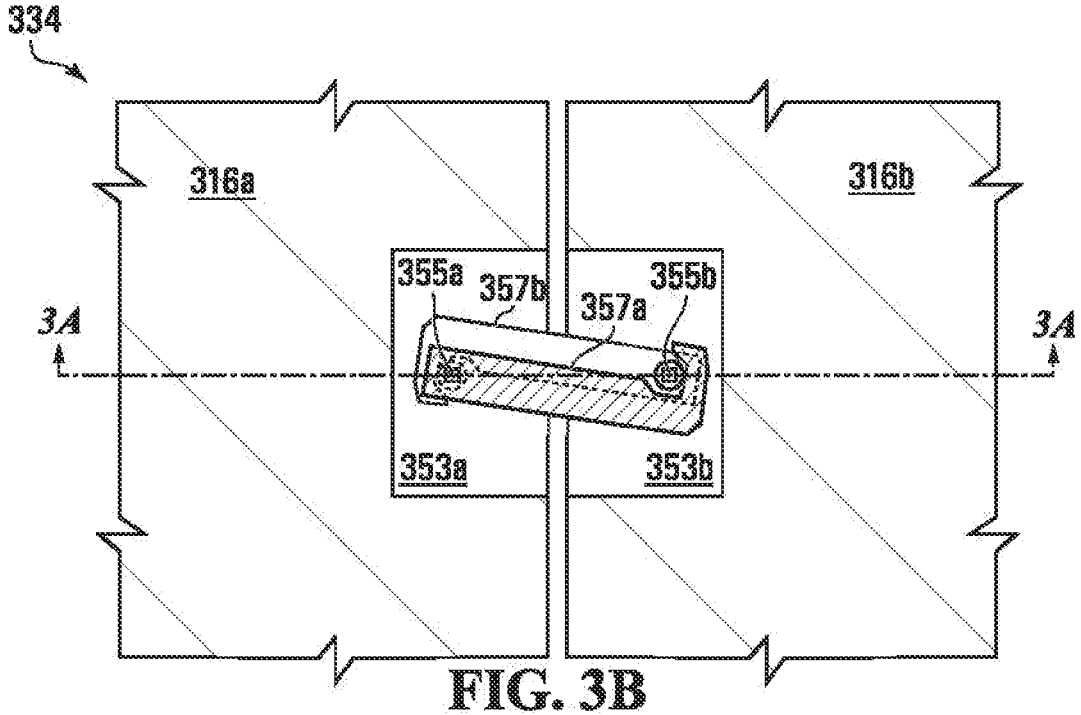

Each of the wall panels 204*a*, 204*b* may be made up of an interior metal sheet 212*a*, 212*b*, an exterior metal sheet 214*a*, 214*b*, and a layer of foam 216*a*, 216*b* disposed between the metal sheets 212, 214. Each of the wall panels 204*a*, 204*b* may include alignment structures. As illustrated, the first wall panel 204*a* may include a groove 242*a* proximate the interior side 244 of the wall 234 and a tongue 240*a* proximate the exterior side 246 of the wall 234. The second wall panel 204*b* may include a tongue 240*b* and a groove 242*b* complementary to those of the first wall panel 204*a*. In other embodiments, the panels 204*a*, 204*b* may include no alignment structures, or may include different alignment structures. Another exemplary in-line wall-to-wall joint made between wall panels having different structures is illustrated in FIGS. 3A-3B and discussed in detail below.

The wall panels 204*a*, 204*b* may have connection structures formed thereon. As shown in FIGS. 2A-2B, the connection structures may comprise a first hole 248*a* formed in the interior side 244 of the first wall panel 204*a* and a second hole 248*b* formed in the interior side 244 of the second wall panel 204*b*. The first hole 248*a* may extend through the portion of the first wall panel 204*a* interior to the groove 242*a*, and may or may not extend through any portion of the first wall panel 204*a* exterior to the groove 242*a*. The second hole 248*b* may extend through the tongue 240*b*. One or more first holes 248*a* and one or more second holes 248*b* may be formed along the length of the wall panels 204*a*, 204*b* proximate the joint.

The holes 248*a*, 248*b* may be formed by drilling into the interior side 244 of wall panels 204*a*, 204*b* that have been manufactured as described above. The holes 248*a*, 248*b* may be formed as part of the manufacturing process or may be formed during later modification of the wall panels 204*a*, 204*b*. In some embodiments, the holes 248*a*, 248*b* may be formed by machining, or by any process of material removal known in the art.

Figure 2C:
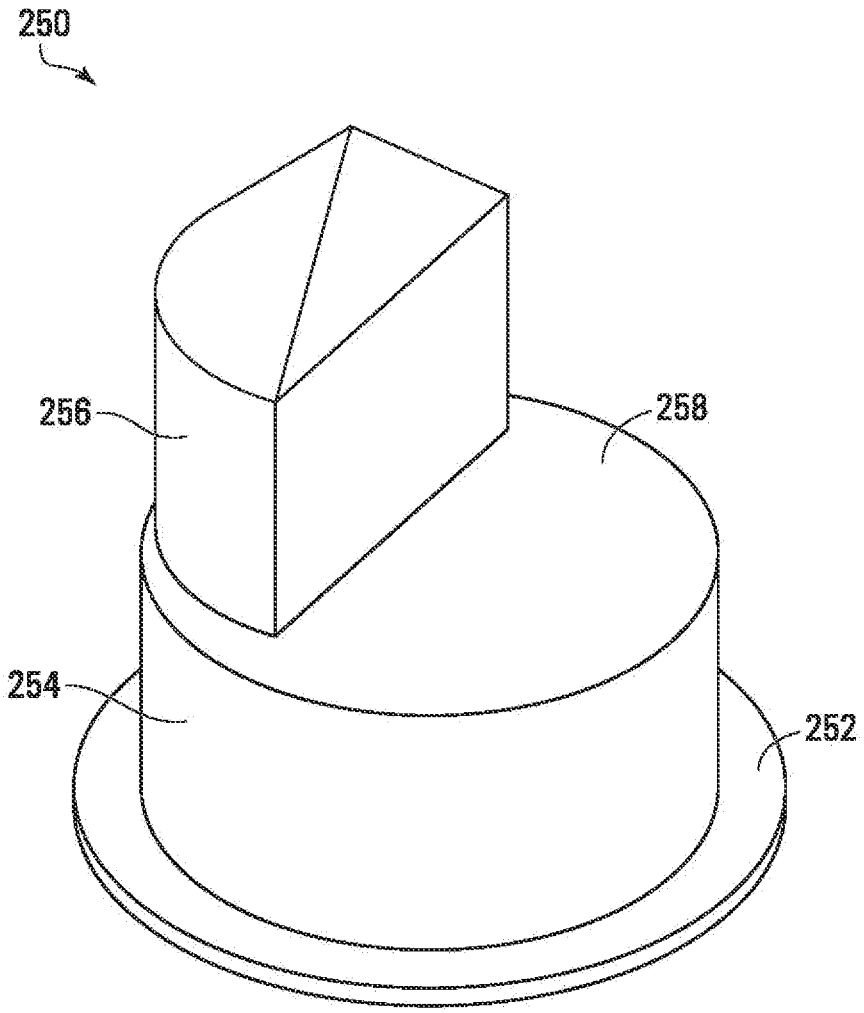

Connection hardware may be used in conjunction with the connection structures to lock the wall panels 204*a*, 204*b* together. As shown in FIGS. 2A-2B, the connection hardware may comprise a cam 250. The cam 250 is shown in more detail in FIG. 2C. The cam 250 may comprise a flange 252, a main aligning shaft 254, and an asymmetric extension 256, having a notch 258 cut away. In some embodiments, the cam 250 may be made of plastic or metal, such as zinc. The cam 250 may be diecast. The diameter of the flange 252 may be larger than the holes 248*a*, 248*b*, such that the flange 252 remains interior to the wall panels 204*a*, 204*b* when the cam 250 is inserted into the holes 248*a*, 248*b*. The main shaft 254 may extend through the portion of the wall panel 204*a* above the groove 242*a*, including the exterior portion of the interior metal sheet 212*a* and the folded-back portion of the interior metal sheet 212*a*. The asymmetric extension 256 may extend through the tongue 240*b* of the second wall panel 204*b*. The foam layers 216*a*, 216*b* and the interior metal sheets 212*a*, 212*b* of the wall panels 204*a*, 204*b* may function as a housing for the cam 250.

Rotating the cam 250 within the holes 248*a*, 248*b* may lock/unlock the wall panels 204*a*, 204*b* to each other. FIG. 2B shows the wall panels 204*a*, 204*b* in an unlocked configuration. In the unlocked configuration, the wall panels 204*a*, 204*b* may be located at a distance from each other, such that a gap is formed between them. The notch 258 of the cam 250 may face the first wall panel 204*a* in the unlocked configuration. FIG. 2A shows the wall panels 204*a*, 204*b* in a locked configuration. In the locked configuration, the wall panels 204*a*, 204*b* may be flush with each other at the interior side 244 and the exterior side 246. The notch 258 of the cam 250 may face the second wall panel 204*b*, such that the asymmetric extension 256 forces the tongue 240*b* of the second wall panel 204*b* against the groove 242*a* of the first wall panel 204*a* in the locked configuration. In some embodiments the foam layers 216*a*, 216*b* may be compressed in the locked configuration.

The tongues 240*a*, 240*b* and grooves 242*a*, 242*b* of the wall panels 204*a*, 204*b* may provide this joint with significant strength. Connection structures as described above may be formed periodically along the length of the wall panels 204*a*, 204*b* proximate the joint. The tongues 240*a*, 240*b* and grooves 242*a*, 242*b* may distribute any load applied to the joint along the entire length of the joint. This may prevent excessive loads from being applied to the connection structures, thereby preventing damage to the wall panels 204*a*, 204*b* proximate the connection structures and increasing the load which the joint can withstand.

Although the connection hardware and connection structures have been described as being formed on the interior side of the wall panels, one may readily envision that they may be formed on the exterior side of the wall panels, or on both sides. Such embodiments may provide greater stability in a structure constructed from the wall panels and may provide greater flexibility in the manner in which such a structure may be assembled.

FIGS. 3A-3B illustrate an in-line wall-to-wall joint according to another embodiment of the present disclosure. The joint may connect a first wall panel 304*a* and a second wall panel 304*b*. The wall panels 304*a*, 304*b* may abut each other along a single wall 334 of a cold storage room. The wall 334 may have an interior side 344 and an exterior side 346. With reference to FIG. 3A, the wall 334 may extend in either a length direction or a width direction.

Each of the wall panels 304*a*, 304*b* may be made up of an interior metal sheet 312*a*, 312*b*, an exterior metal sheet 314*a*, 314*b*, and a layer of foam 316*a*, 316*b* disposed between the metal sheets 312, 314. As shown in FIG. 3A, the edges along which the wall panels 304*a*, 304*b* abut each other, may comprise significant region of exposed foam. This foam may be unexposed in an assembled joint because the metal sheets 312*a*, 314*a* of the first wall panel 304*a* may abut the metal sheets 312*b*, 314*b* of the second wall panel 304*b*. The wall panels 304*a*, 304*b* may be formed by a continuous manufacturing process described above or may be made by a different manufacturing process, such as custom molding. The wall panels 304*a*, 304*b* may or may not include alignment structures.

The wall panels 304*a*, 304*b* may have connection structures formed thereon. The connection structures may include a hole formed along the length of each of the wall panels 304*a*, 304*b* proximate the joint and one or more pockets 353*a*, 353*b* formed in each of the wall panels at the edge where they abut. The holes and the pockets 353*a*, 353*b* may be molded into the foam layer 316*a*, 316*b* of each wall panel 304*a*, 304*b* or may be formed after the wall panel 304*a*, 304*b* is manufactured. For example, the holes may be formed by drilling and the pockets 353*a*, 353*b* may be formed by machining.

Connection hardware may be used in conjunction with the connection structures to lock the wall panels 304*a*, 304*b* together. The connection hardware may comprise a shaft 355*a*, 355*b* which extends through each of the holes and one or more locking arms 357*a*, 357*b* disposed within the pockets 353*a*, 353*b*. The shafts 355*a*, 355*b* may be rotatable. Each of the locking arms 357*a*, 357*b* may be attached to a shaft 355*a*, 355*b*. Although FIG. 3A illustrates a joint including two locking arms 357*a*, 357*b*, some embodiments may include only one locking arm 357*a*. In some embodiments, multiple pockets 353*a*, 353*b* may be formed along the length of each wall panel 304*a*, 304*b* and at least one locking arm 357*a*, 357*b* may be disposed in each pocket 353*a*, 353*b*.

In the embodiment illustrated in FIG. 3B, the shaft is square and the plastic or die cast heads 399*a*-399*d* are seated in the holes with the shaft received in square holes in the heads, either using a friction fit, adhesive or fastener. Turning the head at a desired end will rotate the shaft. A cam member can have a sleeve fitting onto the shaft, for example by friction fit in the case of a plastic cam member. Such a sleeve can provide a round surface for receiving the hook or cam end of an opposed cam member as illustrated. While identical cam parts can be used in the embodiment of FIG. 3B, shown are mirror image parts so that the direction of rotation for locking is the same.

Rotating one or both shafts 355*a*, 355*b* may lock/unlock the wall panels 304*a*, 304*b* from each other. Rotating a shaft 355*a*, 355*b* may rotate the locking arm 357*a*, 357*b* attached to the shaft 355*a*, 355*b* and thereby engage the hooked end of the locking arm 357*a*, 357*b* with the opposite shaft 355*a*, 355*b*. This engagement may lock the wall panels 304*a*, 304*b* to each other.

Using a connection hardware as shown in FIGS. 3A-3B can allow insulated panels having flat side walls to be joined, however, side walls with tongue and groove surfaces will provide connection support along the whole edge of the connected panels.

In both of the embodiments of in-line wall-to-wall joints described above, the wall panels may be held together tightly enough to form a seal therebetween which may prevent solid and liquid contaminants from becoming trapped between the wall panels. In some embodiments, the caps of the cams may similarly form seals to prevent solid and liquid contaminants from becoming trapped within the holes. In some embodiments, covers may be provided over the caps of the cams to perform this function. In this way, the in-line wall-to-wall joint may be safe for use in cold storage rooms used to contain food.

Further, in both of the embodiments of in-line wall-to-wall joints described above, the wall panels may be held together by metal-to-metal junctions between the connection hardware and the metal plates of the wall panels. Specifically, cams used in the joint may have more than one point of contact with metal components. For example, a cam may contact a first layer of an interior plate of a wall panel and a second layer of the interior plate where it is folded to form alignment structures. This may increase the strength of the connections and prevent damage to the foam layers of the panels. In comparison, prior art panels included connection hardware which was only anchored in the foam layer of the panels. This hardware could damage the foam when connections were formed or when loads were applied to the connections. The present disclosure avoids these shortcomings and provides strong joints, which may in turn provide for a long-lasting structure.

One skilled in the art will recognize that the in-line wall-to-wall joints described above may be used to join panels in applications other than cold storage rooms. For example, such joints may be used to connect siding panels or panels used in temporary housing.

Corner Wall-to-Wall Joints

Figure 4A:
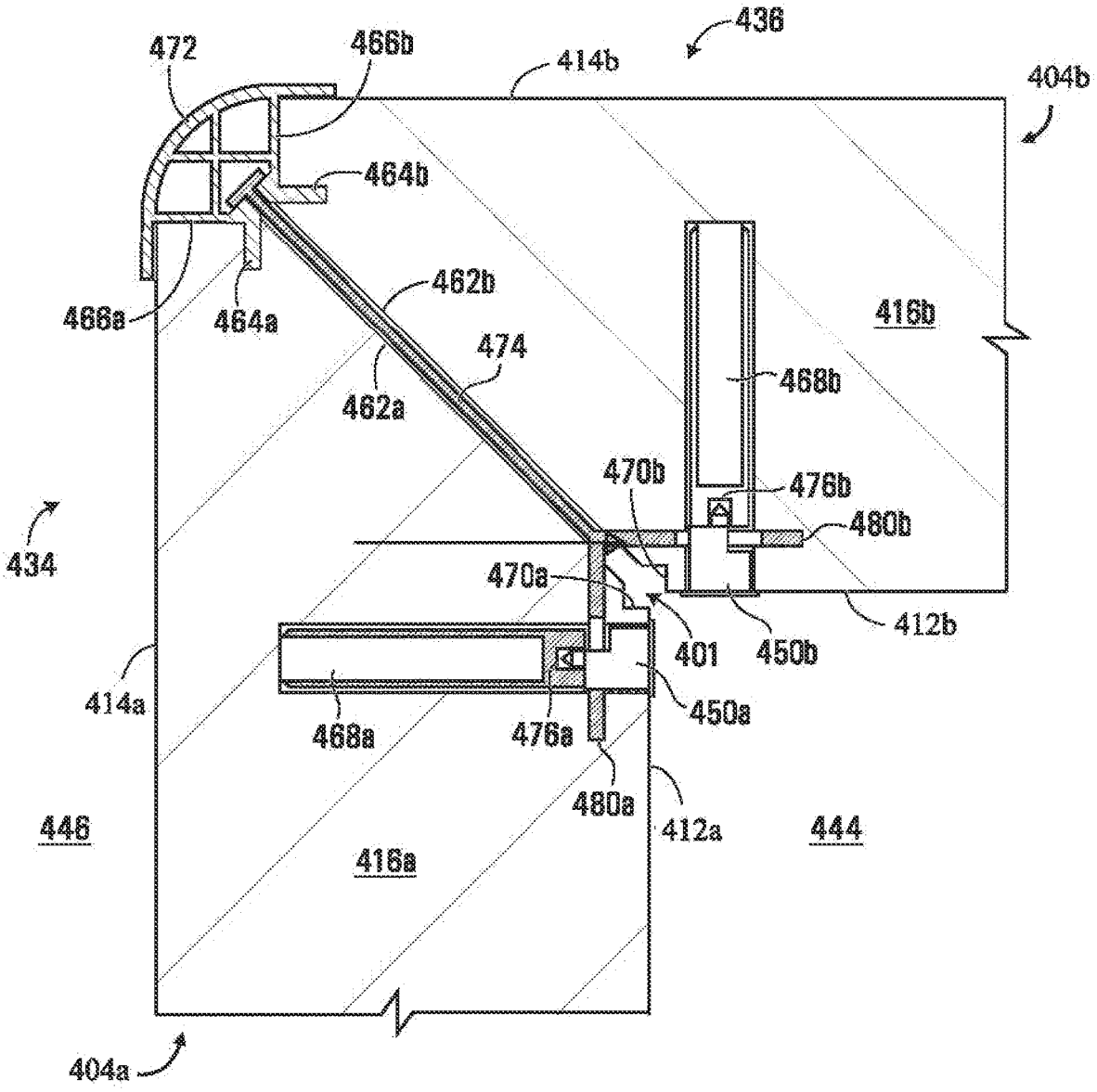
FIGS. 4A-4G are a corner wall-to-wall joint and components thereof in accordance with the present disclosure.

Adjacent wall panels which belong to different walls may be connected to each other at a corner wall-to-wall joint. FIG. 4A illustrates a corner wall-to-wall joint connecting a first wall panel 404*a* and a second wall panel 404*b*. The wall panels 404*a*, 404*b* may abut each other at the corner between two walls 434, 436 of a cold storage room. The walls 434, 436 may have an interior side 444 and an exterior side 446. With reference to FIG. 4A, one wall 434 may extend a length direction and one wall 436 may extend in a width direction.

Each of the wall panels 404*a*, 404*b* may be made up of an interior metal sheet 412*a*, 412*b*, an exterior metal sheet 414*a*, 414*b*, and a layer of foam 416*a*, 416*b* disposed between the metal sheets 412, 414. Each of the wall panels 404*a*, 404*b* may comprise an angled edge 462*a*, 462*b*. As discussed above, the wall panels 404*a*, 404*b* which form the end of a wall 434, 436 may be cut to a width that provides the cold storage room with the proper length or width. The cut may be made at a forty-five degree angle to form the angled edge 462*a*, 462*b*. In this way, the wall panels 304*a*, 304*b* may snuggly abut each other at a right angle.

Although the angled edges 462*a*, 462*b* are illustrated as being cut at forty-five degree angles, one may readily envision alternative embodiments. For example, cuts may be made including steps, grooves, or other alignment structures, such that the alignment structures on the first edge 462*a* complement the alignment structures on the second edge 462*b*. For another example, the angled edges 462*a*, 462*b* may be cut at an angle other than forty-five degrees if the wall panels 404*a*, 404*b* are used in a cold storage room that has a shape other than a rectangular prism—i.e. rhomboid prism, hexagonal prism, or any other polygonal prism. The angled edges 462*a*, 462*b* may also be cut at a different angle if the wall panels 404*a*, 404*b* have different thicknesses.

The wall panels 404*a*, 404*b* may have connection structures formed thereon. Connection hardware may be used in conjunction with the connection structures to lock the wall panels 404*a*, 404*b* together. The connection structures may include the following features: An exterior notch 466*a*, 466*b* and an exterior groove 464*a*, 464*b* formed on each of the wall panels 404*a*, 404*b* proximate the exterior side 446; and a hole 468*a*, 468*b*, an interior groove 480*a*, 480*b*, and an interior notch 470*a*, 470*b* formed on each of the wall panels 404*a*, 404*b* proximate the interior side 444.

The exterior notches 466*a*, 466*b* may be formed by cutting away a portion of the wall panels 404*a*, 404*b*, before or after the angled edges 462*a*, 462*b* have been cut. The exterior grooves 464*a*, 464*b* and the interior grooves 480*a*, 480*b* may be cut into the foam layers 416*a*, 416*b* of the wall panels 404*a*, 404*b*. The exterior notches 466*a*, 466*b*, the interior notch 470*a*, 470*b* and the exterior grooves 464*a*, 464*b* may extend over the entire length of the wall panels 404*a*, 404*b* while the interior grooves 480*a*, 480*b* may be discontinuous and only positioned to be aligned with the location of the holes 468*a*, 468*b*. In some embodiments, the interior grooves 480*a*, 480*b* be continuous as well. The holes 468*a*, 468*b* may be formed by drilling into the interior side 444 of the wall panels 404*a*, 404*b*. These connection features may be formed as part of the manufacturing process or may be formed during later modification of the wall panels 404*a*, 404*b*. In particular, the connection features may be formed before or after the angled edges 462*a*, 462*b* of the wall panels 404*a*, 404*b* have been cut. Any type of saw, drill, or other material removal tool or process known in the art may be used to form the connection features. The processes for forming the connection features may or may not be automated.

The connection structures described above may be configured to interact with connection hardware. The connection hardware may include an exterior rail 472, one or more Y-bracket(s) 474, one or more sleeves 476*a*, 476*b*, and one or more corner cams 450*a*, 450*b*. These elements are illustrated in FIGS. 4B-4E and described in detail below.

Figure 4B:
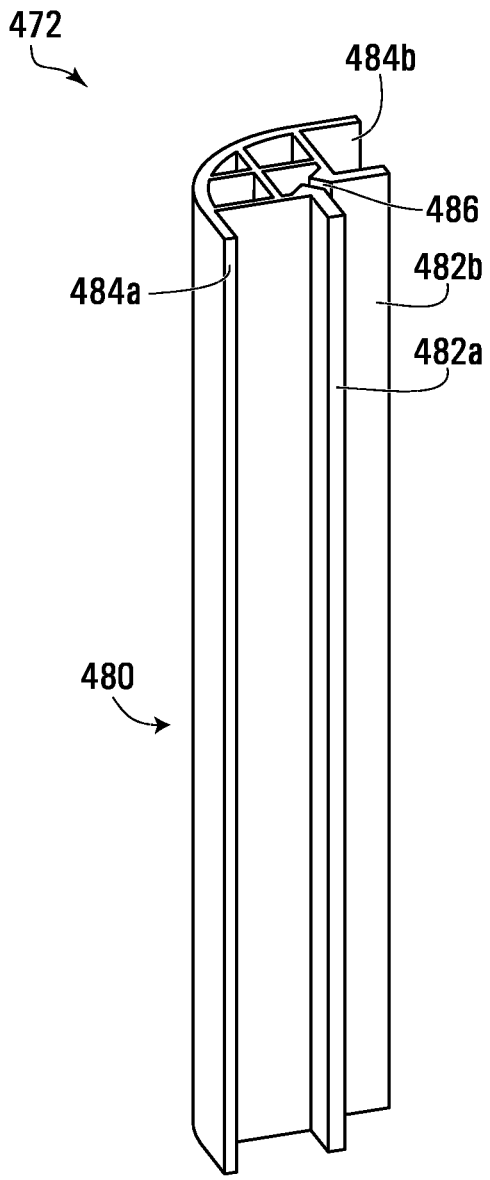

FIG. 4B illustrates an exterior rail 472. The exterior rail 472 may comprise a main body 480, two interior extensions 482*a*, 482*b*, and two exterior extensions 484*a*, 484*b*. The main body 480 may be disposed the exterior notches 466*a*, 466*b* formed in the wall panels 404*a*, 404*b*. The main body 480 may have a curved exterior surface, and may include one or more interior support structures. The exterior face of the main body 480 could be of a different shape, such as an oval shape, a 45 degree angle, or right angle. As shown in FIG. 4B, the support structures may be internal walls which extend over the length of the exterior rail 472, for stiffness purpose. The exterior rail 472 may further comprise one or more interior openings 486, each configured to receive a Y-bracket 474. The exterior rail 472 may be made of plastic, aluminum, pultrusion or any other rigid material.

The exterior rail 472 may extend along the length of the wall panels 404*a*, 404*b*, exterior to the angled edges 462*a*, 462*b* at which the wall panels 404*a*, 404*b* abut. The interior extensions 482*a*, 482*b* and the exterior extensions 484*a*, 484*b* may secure the exterior rail 472 to the wall panels 404*a*, 404*b*. The interior extensions 482*a*, 482*b* may be disposed within the exterior grooves 464*a*, 464*b* of the wall panels 404*a*, 404*b*. The interior extensions 482*a*, 482*b* and the exterior grooves 464*a*, 464*b* may be configured such that the interior extensions 482*a*, 482*b* fit snuggly within the exterior grooves 464*a*, 464*b*. For example, the width of the exterior grooves 464*a*, 464*b* may be smaller than the width of the interior extensions 482*a*, 482*b*. The exterior extensions 484*a*, 484*b* may be disposed on the exterior side 434, 436 of the wall panels 404*a*, 404*b*. The wall panels 404*a*, 404*b* may be snuggly held between the interior extensions 482*a*, 482*b* and the exterior extensions 484*a*, 484*b*.

Figure 4C:
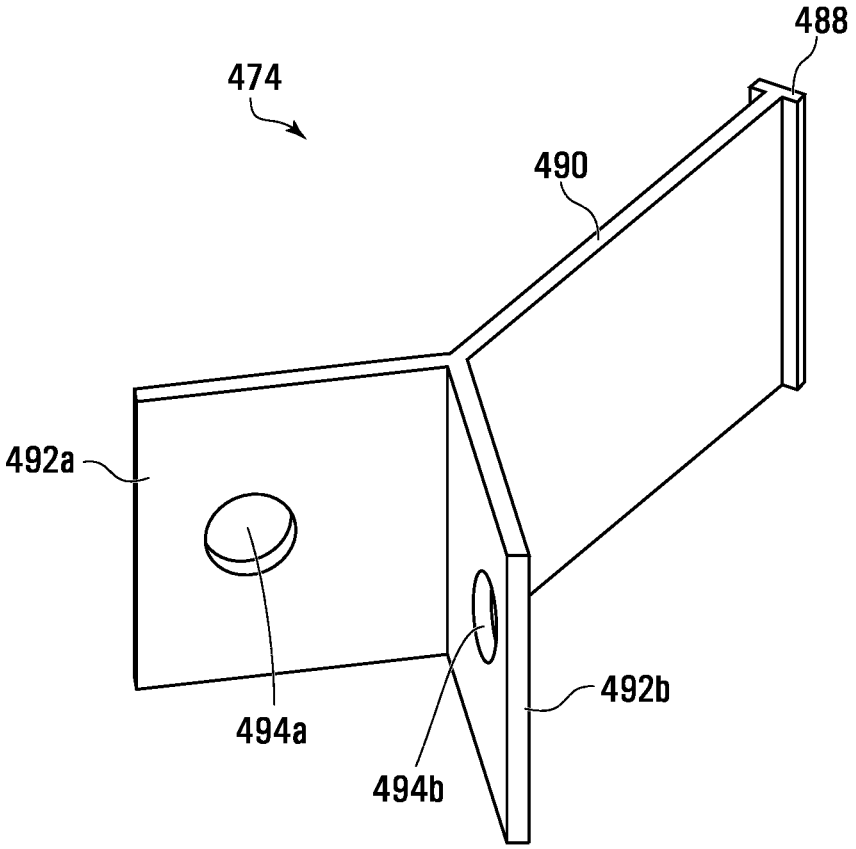

FIG. 4C illustrates a Y-bracket 474. A Y-bracket 474 may include a head 488, a shaft 490, and two arms 492*a*, 492*b*. The two arms 492*a*, 492*b* may extend at a right angle from each other and at a one hundred thirty-five degree angle from the shaft 490. Each arm 492*a*, 492*b* may have a hole 494*a*, 494*b* formed therethrough. The Y-bracket 474 may be made of plastic, aluminum, pultrusion or any other rigid material.

One or more Y-brackets 474 may extend between the angled edges 462*a*, 462*b* of the wall panels 404*a*, 404*b* and connect the exterior rail 472 to the wall panels 404*a*, 404*b*. In some embodiments, multiple Y-brackets 474 may extend between the wall panels 404*a*, 404*b* along the length of the wall panels 404*a*, 404*b*. The head 488 of the Y-bracket 474 may be held by an interior opening 486 of the exterior rail 472. The shaft 490 may extend between the angled edges 462*a*, 462*b* of the wall panels 404*a*, 404*b*. The arms 492*a*, 492*b* may be disposed in the interior grooves 480*a*, 480*b* of the wall panels 404*a*, 404*b*. The holes 494*a*, 494*b* formed in the arms 492*a*, 492*b* may align with the holes 468*a*, 468*b* formed in the wall panels 404*a*, 404*b*, by means of the cam action of 450. In some embodiments, a first Y-bracket 474 may be located proximate the top of the wall panels 404*a*, 404*b* and a second Y-bracket 474 may be located proximate the bottom of the wall panels 404*a*, 404*b* and additional Y-brackets 474 may be located in between.

Figure 4D:
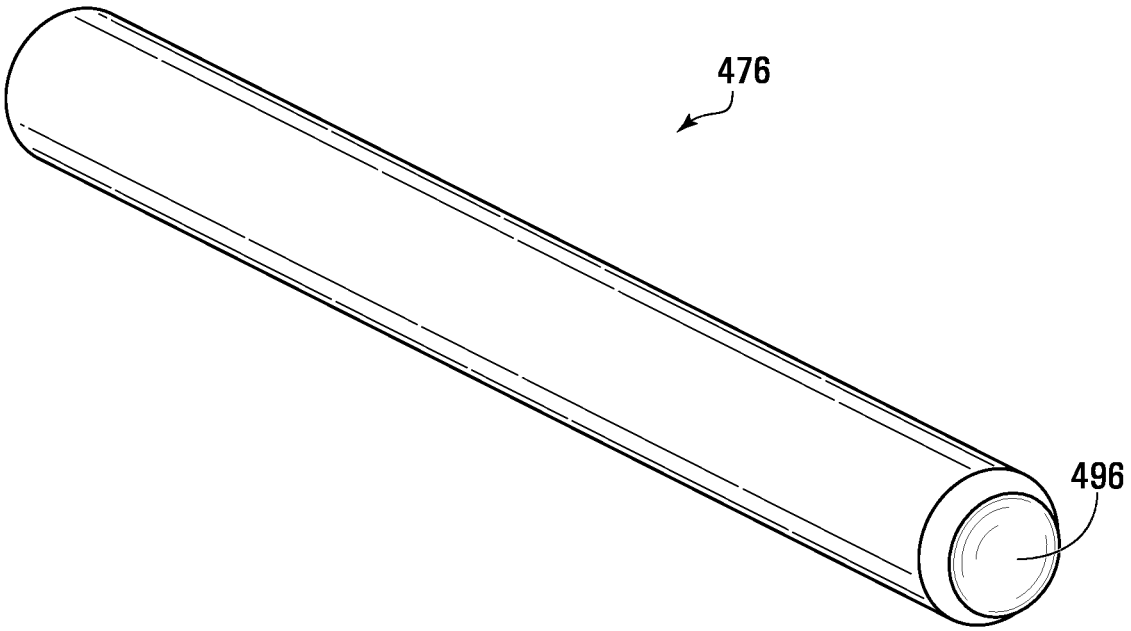

FIG. 4D illustrates a sleeve 476. The sleeve may comprise an internal opening 496, which may be configured to cooperate with a cam 450. As illustrated in FIG. 4A, sleeves 476*a*, 476*b* may be disposed in the holes 468*a*, 468*b* formed in the wall panels 404*a*, 404*b*, such that the sleeves 476*a*, 476*b* fit tightly in the holes 468*a*, 468*b* and it could be glued or not, in place. The sleeves 476*a*, 476*b*, when in position, shall clear the notches 380*a*, 380*b* for allowing the arms 492*a*, 492*b* to be inserted in it. The sleeve 476 may be made of plastic, aluminum, zinc cast, or any other rigid material.

Figure 4E:
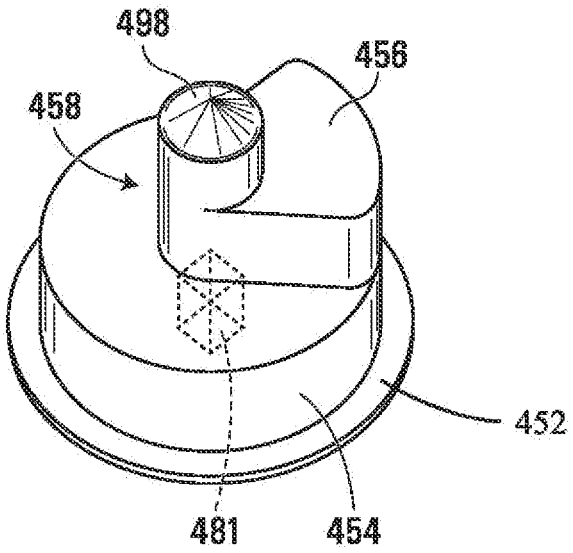

FIG. 4E illustrates a cam 450. The cam 450 may comprise a flange 452, a main shaft 454, an asymmetric extension 456 having a notch 458 cut away, and a central extension 498. In some embodiments, the cam 450 may be made of plastic, aluminum, pultrusion or any other rigid material. As illustrated in FIG. 4A, the extensions 498*a*, 498*b* of the cams 450*a*, 450*b* may be disposed within the internal openings 496*a*, 496*b* of each of the sleeves 476*a*, 476*b* as a pivot point for the rotation of the cam 450*a*, 450*b*. The diameter of the flange 452 may be larger than the holes 468*a*, 468*b* to prevent the cam 450 from passing through the internal steel face 414*a*, 414*b*, the latter acting as a second pivot point for the cam 450*a*, 450*b*. Rotating the cams 450*a*, 450*b* within the sleeves 476*a*, 476*b* will apply pressure on the arm holes 494*a*, 494*b* by its asymmetric extensions 456*a*, 456*b*, which may lock/unlock the arms 492*a*, 492*b* to the wall panels 404*a*, 404*b*, and may thereby lock/unlock the wall panels 404*a*, 404*b* from each other. In some embodiments, the cam 450 may include a socket 481 formed on a base thereof.

The connection structures and hardware described above may form a strong angle joint. In particular, loads which are applied to the joint may be distributed along the length of the wall panels 404*a*, 404*b* proximate the joint. The exterior rail 472 may distribute any applied load along its length and may act as a corner guard as well. The Y-brackets 474 may pull the wall panels 404*a*, 404*b* tightly against the exterior rail 472, by means of the action of the cam 450, making the joint both airtight and mechanically solid. The sleeves 476 may distribute load along their lengths, preventing excessive load from being applied to any single area of the interior foam layers 416*a*, 416*b*. This may prevent the foam, having low compression strength, from being crushed. These features may increase the force which the corner-to-corner joint is capable of withstanding without experiencing damage. The above concept may also allow fastening corner panels together, all by the inside. This feature may be beneficial as an enclosure is often installed in the corner of a building and there is no exterior access to perform the assembly.

Further, in the corner wall-to-wall joint described above, the wall panels may be held together by metal-to-metal junctions between the connection hardware and the metal faces of the wall panels. Specifically, cams used in the joint may have more than one point of contact with metal components. For example, a cam may contact an interior face of a wall panel and a metal insert. This may increase the strength of the connections and prevent damage to the foam layers of the panels. In comparison, prior art panels included connection hardware which was only anchored in the foam layer of the panels. This hardware could damage the foam, and loosening the connection, when connections were formed or when loads were applied to the connections. The present disclosure avoids these shortcomings and provides strong joints, which may in turn provide for a long-lasting structure.

As shown in FIG. 4A, a corner wall-to-wall joint may further include an interior joint cover 401. The interior joint cover 401 may be received by the interior notches 470*a*, 470*b* formed in the wall panels 404*a*, 404*b*. The interior joint cover 401 may cover the junction between the wall panels 404*a*, 404*b* and may form a seal preventing solid and liquid contaminants from becoming trapped between the wall panels 404*a*, 404*b* while providing a coved corner that ease the cleaning. In some embodiments, the flanges 452*a*, 452*b* of the cams 450*a*, 450*b* may similarly form seals to prevent solid and liquid contaminants from becoming trapped within the holes 468*a*, 468*b*. In some embodiments, covers may be provided over the flanges 452*a*, 452*b* of the cams 450*a*, 450*b* to perform this function as well as covering the socket connection for the rotating tool. In this way, the corner wall-to-wall joint may be safe for use in cold storage rooms used to contain food.

Figure 4F:
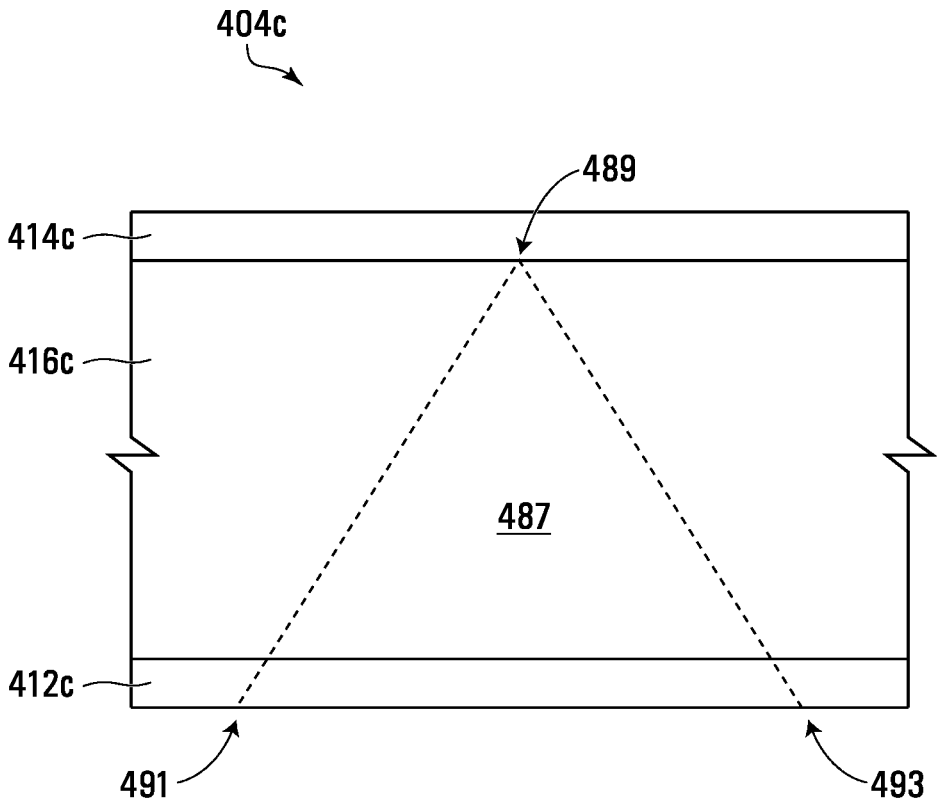
Figure 4G:
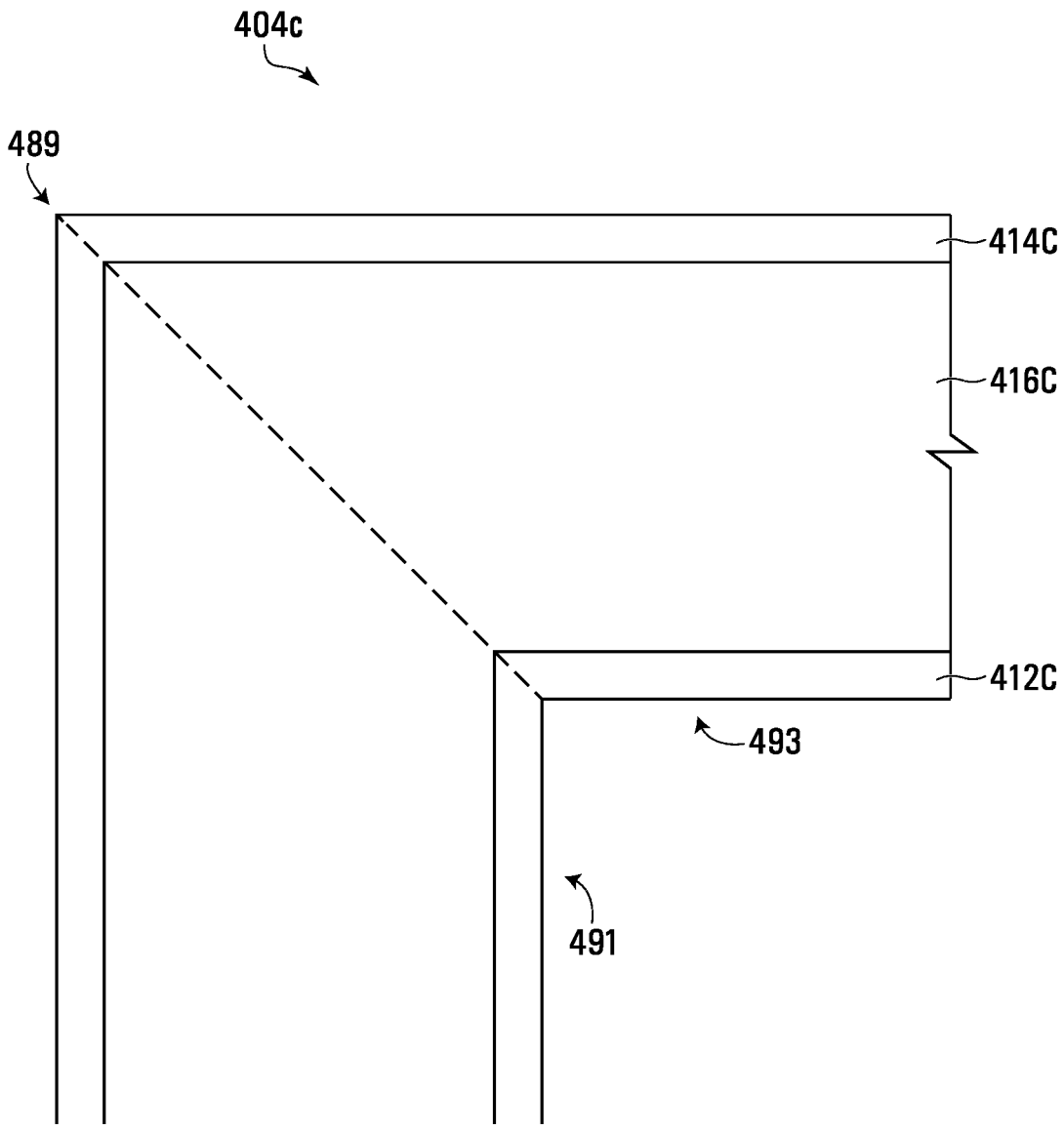

FIGS. 4F and 4G illustrate an alternative corner joint formed from a wall panel 404*c*. Both figures illustrate a top view of the wall panel 404*c*. The wall panel 404*c* may be made up of an interior metal sheet 412*c*, an exterior metal sheet 414*c*, and a layer of foam 416*c* disposed between the metal sheets 412*c*, 414*c*. As shown in FIG. 4F, the interior metal sheet 412*c* and the foam layer 416*c* may be cut to form a ninety-degree incision 487 along the length of the wall panel 404*c*. The exterior metal sheet 414*c* may remain intact. The incision 487 may be made using any tools known in the art. As illustrated in FIG. 4G, the wall panel 404*c* may be folded along an exterior corner 489 of the incision 487, such that a first side of the wall panel 491 is disposed at a right angle to a second side 493 of the wall panel. The incision 487 may be formed in the wall panel at a desired position along the width of the wall panel 404*c*, such that the first side 491 and the second side 493 each have a desired width.

A corner joint as illustrated in FIGS. 4F-4G may use similar connection hardware to that illustrated in FIG. 4A, but may not include an exterior rail. The corner joint may also provide similar advantages to the corner wall-to-wall joint illustrated in FIG. 4A. The two sides 491, 493 may be used in a cold storage room or other structure similarly to the two wall panels 404*a*, 404*b* shown in FIG. 4A. A cold storage room or other structure may include some corner wall-to-wall joints in accordance with FIG. 4A and other corner joints in accordance with FIG. 4G.

One skilled in the art will recognize that the corner wall-to-wall joints described above may be used to join panels in applications other than cold storage rooms. For example, such joints may be used to connect siding panels or panels used in temporary housing, dry storage, clean rooms, environmental room, growth chamber or any other similar enclosures.

Wall-to-Ceiling Joint

Figure 5A:
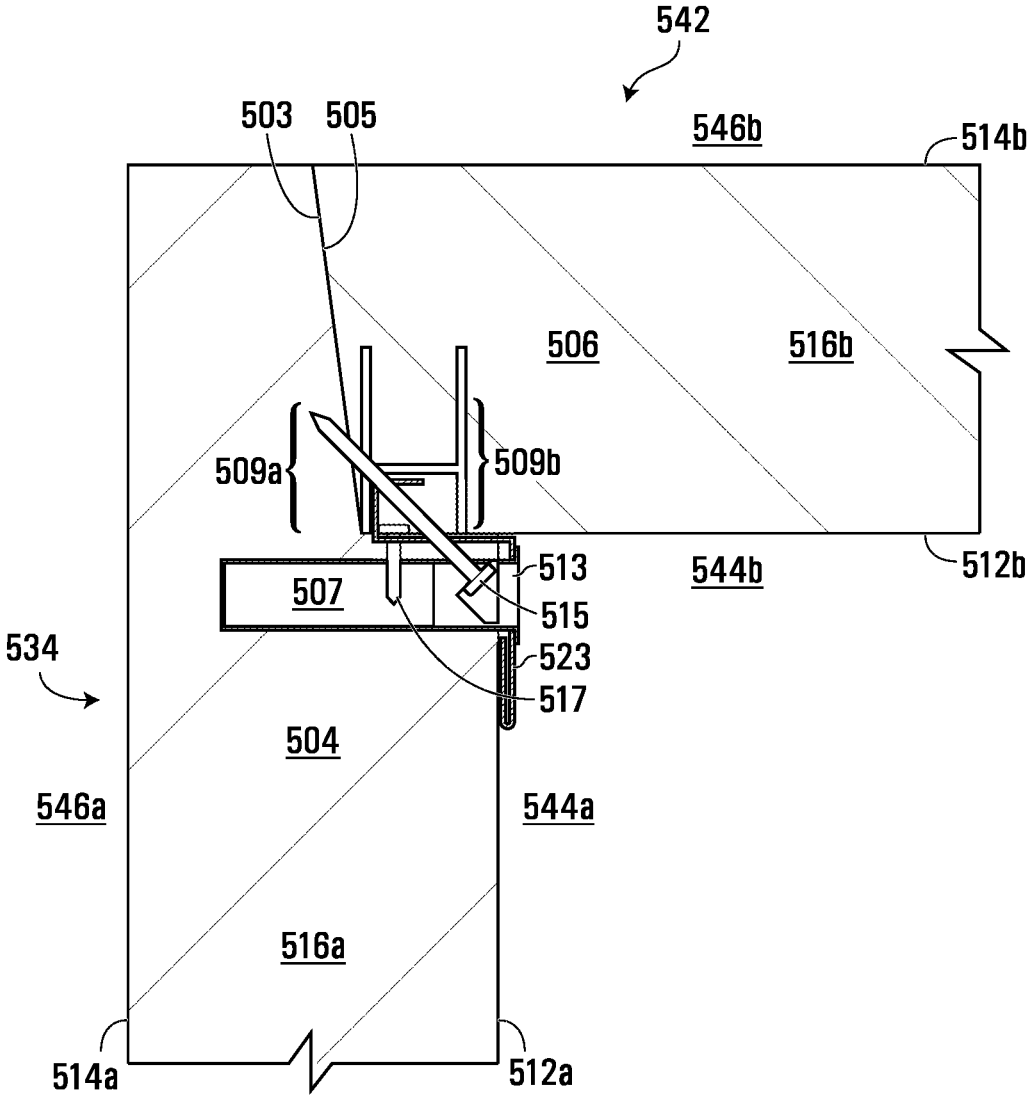
FIGS. 5A-5F are a wall-to-ceiling joint and components thereof in accordance with the present disclosure.

Adjacent wall panels and ceiling panels may be connected to each other at a wall-to-ceiling joint. FIG. 5A illustrates a wall-to-ceiling joint connecting a wall panel 504 and a ceiling panel 506. The panels 504, 506 may abut each other at the corner between a wall 534 and a ceiling 542 of a cold storage room. The wall 534 and ceiling 542 may have an interior side 544*a*, 544*b* and an exterior side 546*a*, 546*b*. With reference to FIG. 5A, the wall 534 may extend in either a length direction or a width direction.

Figure 5B:
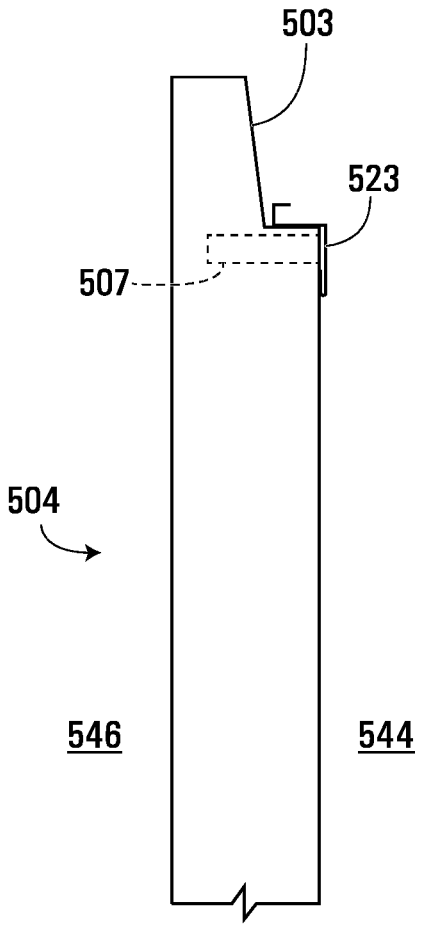
Figure 5C:
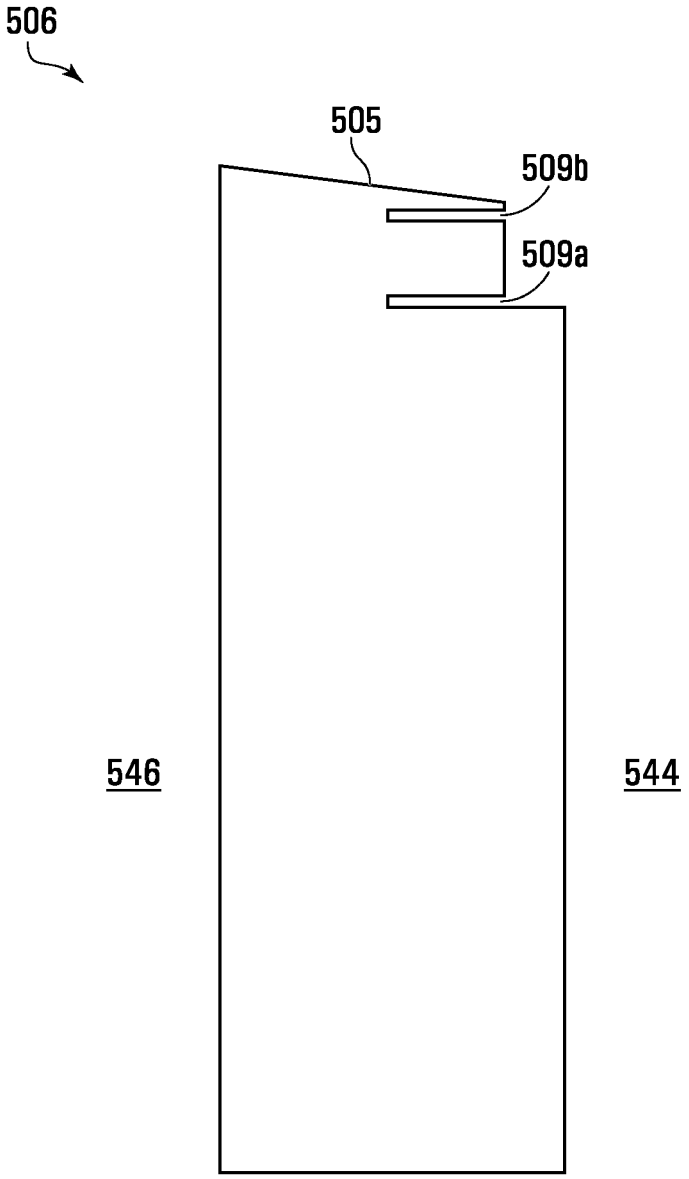

Each of the panels 504, 506 may be made up of an interior metal sheet 512*a*, 512*b*, an exterior metal sheet 514*a*, 514*b*, and a layer of foam 516*a*, 516*b* disposed between the metal sheets 512, 514. The wall panel 504 may comprise a notched edge 503 and the ceiling panel may comprise an angled edge 505. As discussed above, ceiling panels 506 may be cut to a width that provides the cold storage room with the proper length or width. The top edge of a wall panel 504 may not be cut to modify the length of the wall panel 504, but a cut may be made to form the wall-to-ceiling joint. The top edge of the wall panel 504 may be cut to form a notched edge 503, as shown in FIG. 5B. The notched edge 503 may generally have an obtuse angle configuration. The edge of the ceiling panel 506 may be cut at an angle complementary to the notched edge 503 to form the angled edge 505, as shown in FIG. 5C. In this way, the wall panel 504 and the ceiling panel 506 may abut each other at a right angle. In some embodiments, the notched edge 503 may seal snuggly with the angled edge 505, that could have a different shape as well. Any type of saw, drill, or other material removal tool or process known in the art may be used to form these edges. The notched edge 503 may allow the ceiling panel 506 to fit onto wall panels 504 which have already been assembled in a cold storage room or other structure without jamming.

An interior shoulder of the notched edge 503 may be covered by a moulding 523. FIG. 5F shows a moulding 523 in more detail. In some embodiments, this interior shoulder of wall 504 may be rough due to the cutting or other machining performed to create the notched edge 503. The moulding 523 may cover any rough portions or imperfections, thereby providing a smooth interior edge on top of the wall panel 504. This smooth surface may be easily cleanable and suitable for food storage or storage of sensitive materials. The moulding may also guide the positioning and securing of connection hardware, such as a ceiling rail 511 described below, during assembly of the wall-to-ceiling joint. The moulding may be secured to the wall panel 504 with the insert 513 inserted into the hole 524 of the moulding 523 and then in the panel hole 507 and then secured with one or more screws 517, each one fastened to an insert 513.

The wall panel 504 and the ceiling panel 506 may have connection structures formed thereon. Connection hardware may be used in conjunction with the connection structures to lock the wall panel 504 and the ceiling panel 506 together. The connection structures may include the following features: a hole 507 formed in the interior side 544*a* of the wall panel 504 and two grooves 509*a*, 509*b* formed in the interior side 544*b* of the ceiling panel 506.

The grooves 509*a*, 509*b* may be cut into the foam layer 516*b* of the ceiling panel 506. The grooves 509*a*, 509*b* may extend over the entire length or width of a ceiling panel 506. The hole 507 may be formed by drilling into the interior side 544*a* of the wall panel 504. In some embodiments, multiple holes 507 may be formed across the width of a wall panel 504. These connection features may be formed as part of the manufacturing process or may be formed during later modification of the panels 504, 506. In particular, the connection features may be formed, before or after the angled edge 507 of the ceiling panel 506 and the notched edge 505 of the wall panel 504 have been cut. Any type of saw, drill, or other material removal tool or process known in the art may be used to form the connection features. The processes for forming the connection features may or may not be automated.

The connection structures described above may be configured to interact with connection hardware. The connection hardware may include a ceiling rail 511, a sleeve 513, one or more screws 515, 517, and a moulding 523. These elements are illustrated in FIGS. 5A and 5D-5F and are described in detail below.

Figure 5D:
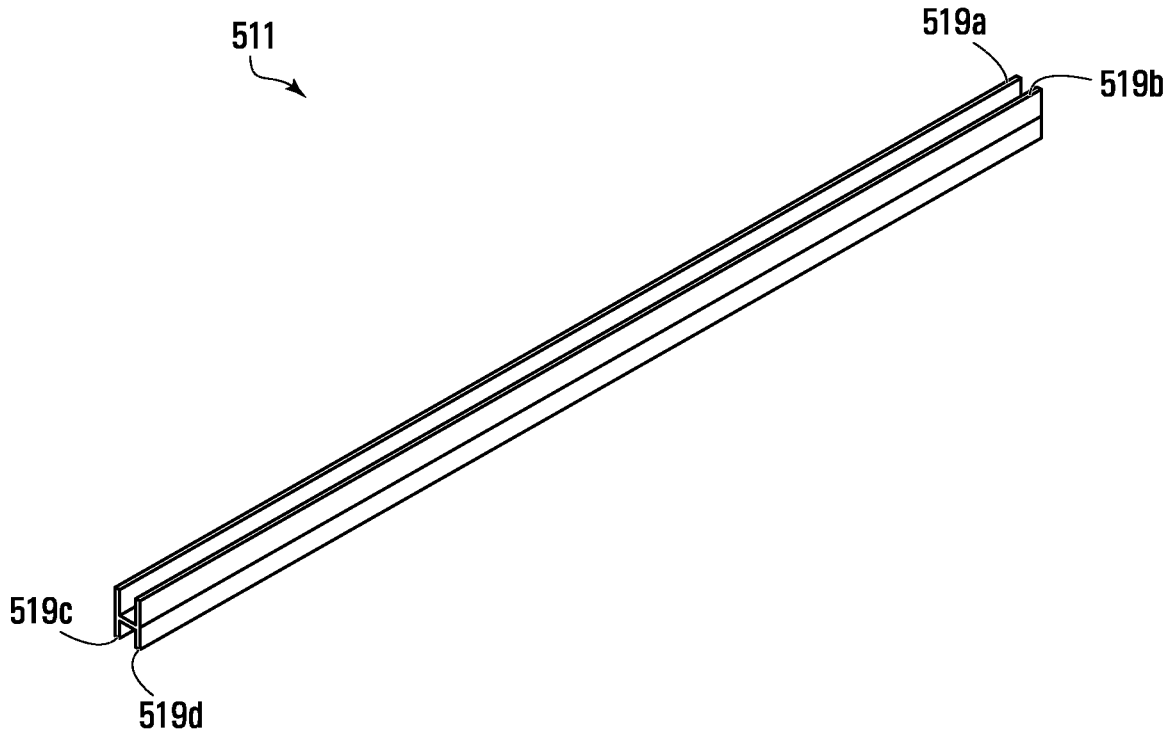

FIG. 5D illustrates a ceiling rail 511. The ceiling rail 511 may have an "H" profile, featuring two upper extensions 519*a*, 519*b* and two lower extensions 519*c*, 519*d*. The ceiling rail 511 may extend along the length or width of a ceiling panel 506 on the interior side 544*b* of the ceiling panel 506. The upper extensions 519*a*, 519*b* may be disposed within the grooves 509*a*, 509*b* of the ceiling panel 506. The upper extensions 519*a*, 519*b* may fit loosely within the grooves 509*a*, 509*b*, allowing to fill the gaps with adhesive, thus allowing a high bound with the insulation 516*b*. The longer the 519*a*, 519*b* extensions are, the better the bond with insulation 516*b* may be. The length of the ceiling rail 511, combined with the surface of the upper extension 519*a*, 519*b* that spread the load in the foam 516*b*, may allow any load applied to the wall-to-ceiling joint to be distributed over a significant distance, and thereby prevent any portion of the panel from experiencing a damaging load. The ceiling rail 511 may include one or more pre-formed holes-512, formed through its extensions 519 to allow screws 515 to extend therethrough as described below. In some embodiments, the pre-formed holes may be formed in tight intervals to allow screws 515 to be readily inserted, regardless of any relative position of the sleeve 513, on the wall. The ceiling rail 511 may be formed from a single folded sheet of metal, such that the upper extensions 519*a*, 519*b* each comprise two layers of metal, allowing higher fastening strength for screw 515, while the lower extensions 519*c*, 519*d* each comprise a single layer of metal, which is only required to bond to the foam 516*b*. The ceiling rail 511 may also be made of an aluminum extrusion or any other profile with adequate stiffness for the purpose.

Figure 5E:
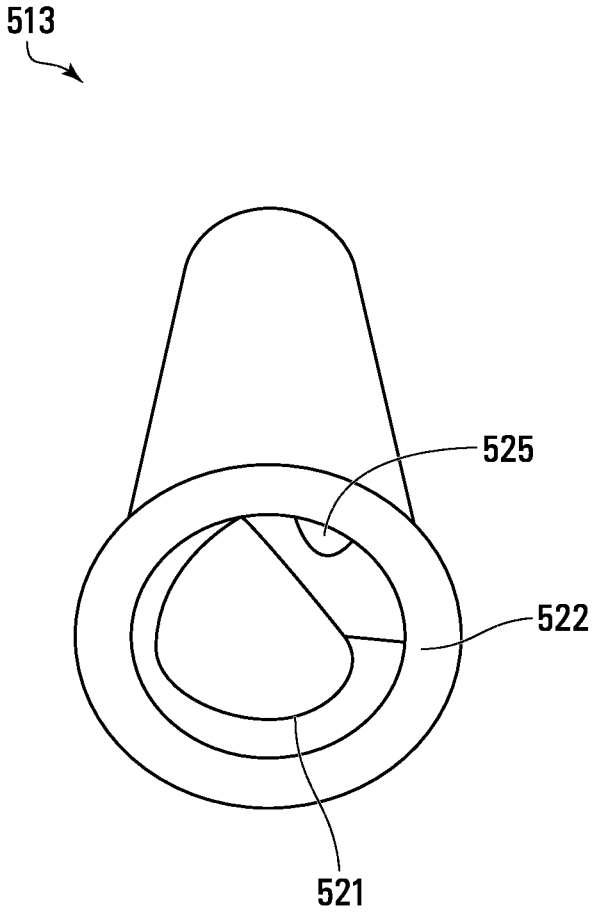
Figure 5F:
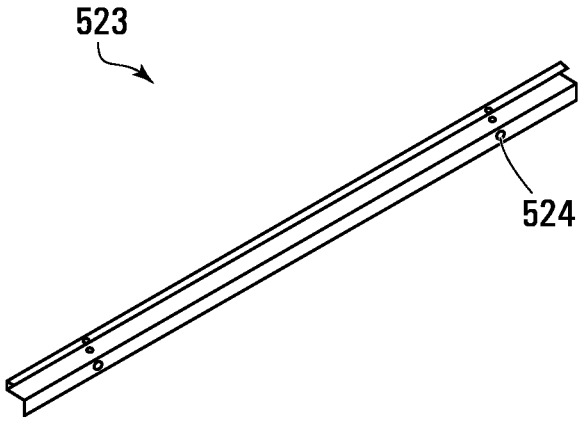

FIG. 5E illustrates a sleeve 513. The sleeve may comprise an internal opening 521, which may be configured to cooperate with a screw 515, by having a recessed surface with a hole 525, at a 45 degree angle, aligning the screw 515 toward the fastening holes 512 on the corner of the ceiling rail 511. The sleeve 513 may also comprise a flange 522. As illustrated in FIG. 5A, sleeve 513 may be disposed in the hole 507 formed in the wall panel 504, such that the sleeve 513 fits tightly in the hole 507. The diameter of the flange 522 may be larger than hole 507, such that the flange 522 remains interior to the wall panel 504 when the sleeve 513 is inserted into the hole 507. The sleeve 513 could also be glued in the hole 507 for added strength.

As shown in FIG. 5A, one or more screws 515 may connect the ceiling rail 511 and the sleeve 513, that are respectively bonded to the ceiling panel 506 and the wall panel 504. A screw 515 may extend diagonally from the internal opening 521 of the sleeve, through the wall panel 504, through the ceiling rail 511, through the ceiling panel 506, and back into the wall panel 504. The screw 515 may extend through a pre-formed hole in the ceiling rail 511. The screw 515 may be self-tapping, which may allow it to extend readily into the fastening holes 512 of the rail 511. The screw may extend directly upwards from the insert, or may extend upwards at a slight side angle to reach one of the fastening holes 512 of the rail 511. Although two screws 515, 517 are illustrated in FIG. 5A, one skilled in the art may readily envision a variety of ways in which screws or other elements may be used to secure the ceiling rail 511, the sleeve 513, the moulding 523 and/or other components in position.

In the embodiments described above, with a gasket inserted in between, the wall and ceiling panels may be held together tightly enough to form a seal therebetween which may prevent solid and liquid contaminants from becoming trapped between the wall panels. In some embodiments, the openings of the sleeves may similarly form seals to prevent solid and liquid contaminants from becoming trapped within the holes. In some embodiments, covers may be provided over the sleeves to perform this function. The moulding 523 which may be used in the wall-to-ceiling joint may also form a seal over the cut portion of the wall panel. In this way, with a gasket inserted in between, the wall-to-ceiling joints may be safe for use in cold storage rooms used to contain food.

The connection structures and hardware described above may form a strong joint. In particular, loads which are applied to the joint may be distributed along the width of the wall panel 504 and the length or width of the ceiling panel 506 proximate the joint. The ceiling rail 511, strongly bonded to the foam 516*b*, may distribute any applied load along its length. The sleeves 513, each one secured in the hole 507 of the steel skin 512*a* and then extended into the foam 516*a* may distribute load along the surface of the wall panel 544*a* and through the foam 516*a*, preventing excessive load from being applied to any single area of the interior foam layers 516*a*. This may prevent the foam from being crushed. One or more screws 515 may pull the ceiling rail 511 and the ceiling panel 506 tightly against the wall panel 504, thereby making the joint both airtight and mechanically solid. These features may increase the force which the corner-to-corner joint is capable of withstanding without experiencing damage.

Further, in the wall-to-ceiling joint described above, the panels may be held together by metal-to-metal junctions between the connection hardware and the metal plates of the panels. Specifically, screws used in the joint may have more than one point of contact with metal components. In comparison, prior art panels included connection hardware which was only anchored in the foam layer of the panels. This hardware could damage the foam when connections were formed or when loads were applied to the connections, that become loose, eventually. The present disclosure avoids these shortcomings and provides strong joints, which may in turn provide for a long-lasting structure. The above concept may also allow fastening wall and ceiling panels together, all via the inside surfaces of the panels. This feature may be advantageous as an enclosure is often installed with limited access between the enclosure ceiling and the ceiling of the building and there is no exterior access to perform the assembly.

One skilled in the art will recognize that the wall-to-ceiling joints described above may be used to join panels in applications other than cold storage rooms. For example, such joints may be used to connect siding panels or panels used in temporary housing, dry storage, clean rooms, environmental room, growth chamber or any other similar enclosures.

Wall-to-Floor Joint

Figure 6A:
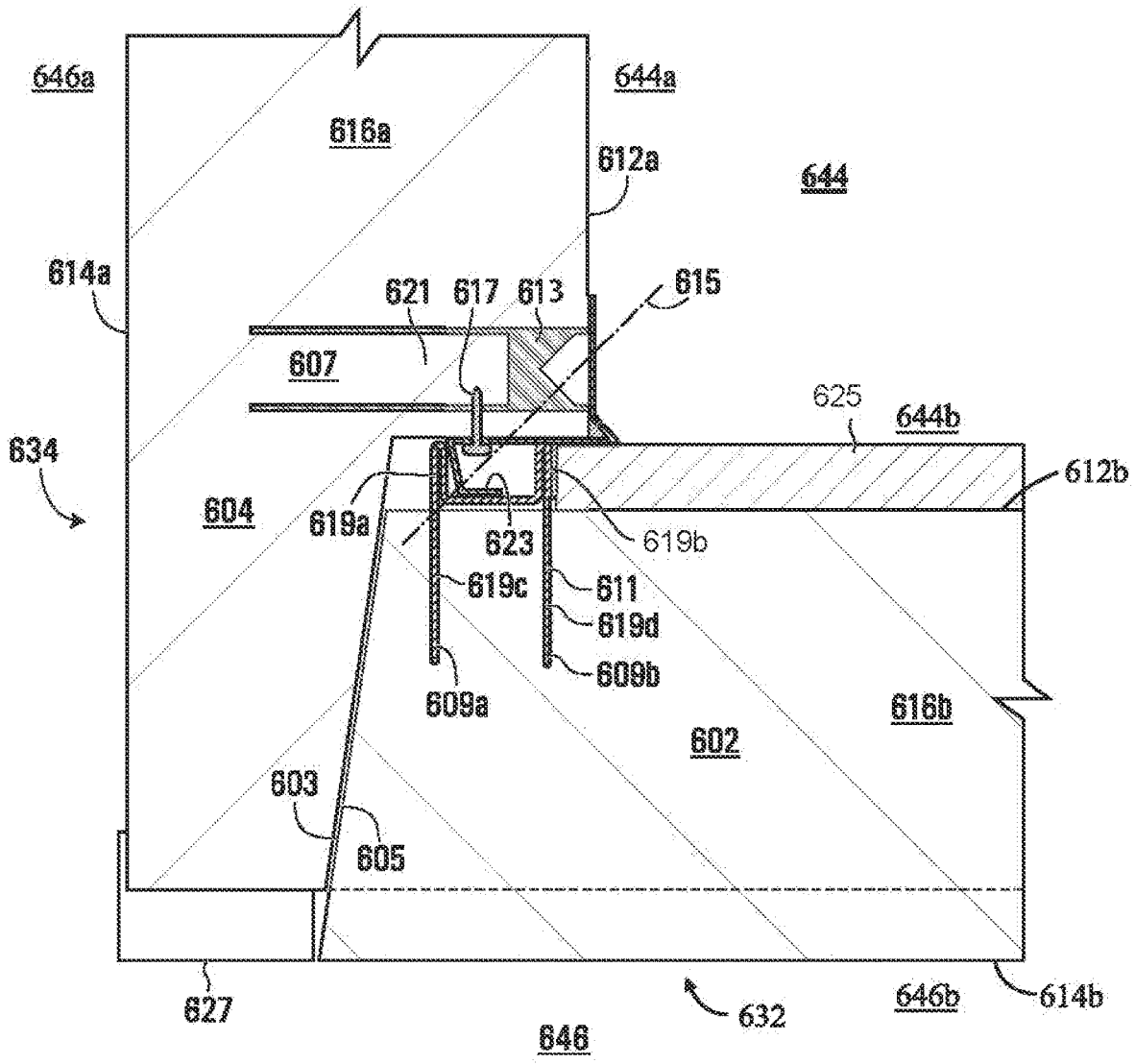
FIGS. 6A-6C are a wall-to-floor joint and components thereof in accordance with the present disclosure.

Adjacent wall panels and floor panels may be connected to each other at a wall-to-floor joint. FIG. 6A illustrates a wall-to-floor joint connecting a wall panel 604 and a floor panel 602. The panels 602, 604 may abut each other at the corner between a wall 634 and a floor 632 of a cold storage room. The wall 634 and the floor 632 may have an interior side 644*a*, 644*b* and an exterior side 646*a*, 646*b*. With reference to FIG. 6A, the wall 634 may extend in either a length direction or a width direction.

Figure 6B:
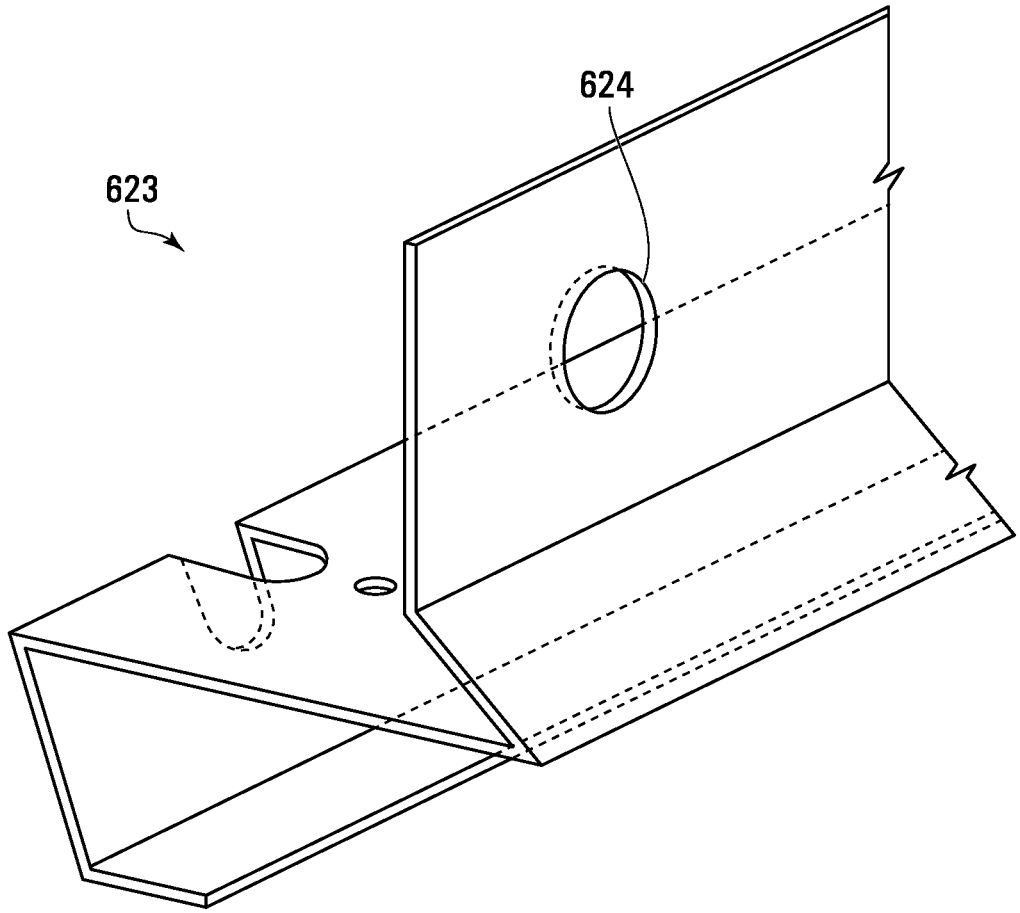
Figure 6C:
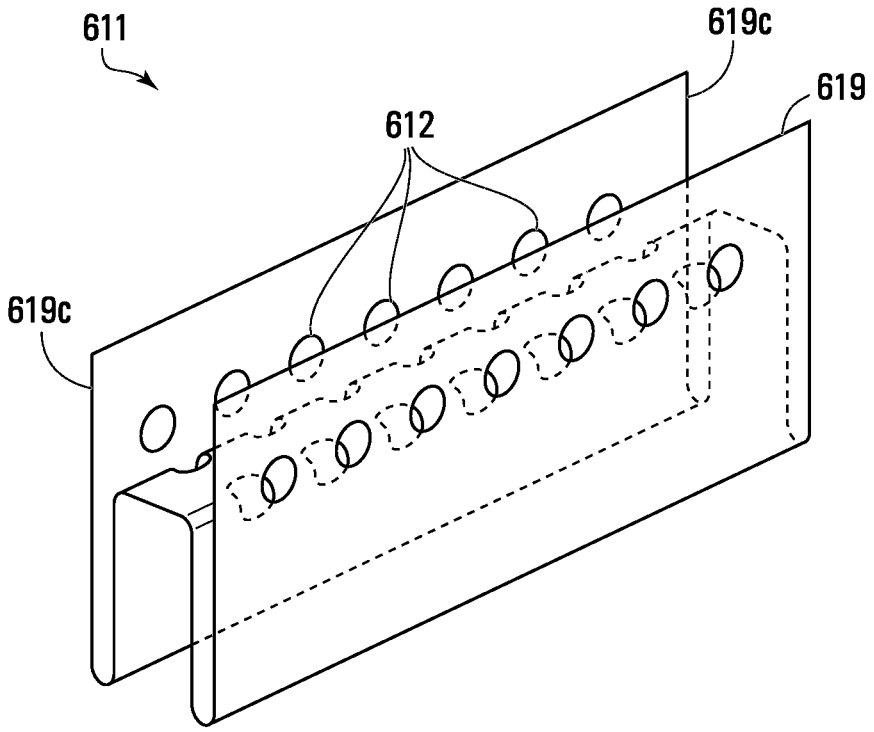

Each of the panels 602, 604 may be made up of an interior metal sheet 612*a*, 612*b*, an exterior metal sheet 614*a*, 614*b*, and a layer of foam 616*a*, 616*b* disposed between the metal sheets 612, 614. The wall panel 604 may comprise a notched edge 603 and the floor panel 602 may comprise an angled edge 605. As discussed above, floor panels 602 may be cut to a width that provides the cold storage room with the proper length or width. The bottom edge of a wall panel 604 may not be cut to modify the length of the wall panel 604, but a cut may be made to form the wall-to-floor joint. The bottom edge of the wall panel 604 may be cut to form a notched edge 603. The notched edge 603 may generally have an obtuse angle configuration. The edge 605 of the floor panel 602 may be cut at an angle complementary to the notched edge 603 to form the angled edge 605. In this way, the wall panel 604 and the floor panel 602 may abut each other at a right angle on the exterior side 646 and the interior side 644. In some embodiments, the notched edge 603 may seal snuggly with the angled edge 605, that could have a different shape as well. Any type of saw, drill, or other material removal tool or process known in the art may be used to form these edges. An interior shoulder of the notched edge 603 may be covered by a moulding 623. FIGS. 6B and 6C show a moulding 623 in more detail. In some embodiments, this interior shoulder of wall 604 may be rough due to the cutting or other machining performed to create the notched edge 603. The moulding 623 may cover any rough portions or imperfections, thereby providing a smooth interior edge on top of the wall panel 504. Its shape is different than the wall to ceiling moulding 523, as it is shaped to achieve a coved corner between the wall 604 and floor 602 for ease of cleaning at the floor. This smooth surface may be easily cleanable and suitable for food storage or storage of sensitive materials. The moulding may also guide the positioning and securing of connection hardware, such as a floor rail 611 described below, during assembly of the wall-to-floor joint. The moulding may be secured to the wall panel 604 with the insert 613 (similar to insert 513) inserted into the hole 624 of the moulding 623 and then in the panel hole 607 and then secured with one or more screws 617, each one fastened to an insert 613.

The wall panel 604 and the floor panel 602 may have connection structures formed thereon. Connection hardware may be used in conjunction with the connection structures to lock the wall panel 604 and the floor panel 602 together. The connection structures may include the following features: a hole 607 formed in the interior side 644*a* of the wall panel 604 and two grooves 609*a*, 609*b* formed in the interior side 644*b* of the floor panel 602.

The grooves 609*a*, 609*b* may be cut into the foam layer 616*b* of the floor panel 602. The grooves 609*a*, 609*b* may extend over the entire length or width of the floor panel 602. The hole 607 may be formed by drilling into the interior side 644*a* of the wall panel 604. In some embodiments, multiple holes 607 may be formed across the width of a wall panel 604. These connection features may be formed as part of the manufacturing process or may be formed during later modification of the panels 602, 604. In particular, the connection features may be formed, before or after the angled edge 607 of the floor panel 602 and the notched edge 605 of the wall panel 604 have been cut. Any type of saw, drill, or other material removal tool or process known in the art may be used to form the connection features. The processes for forming the connection features may or may not be automated.

The connection structures described above may be configured to interact with connection hardware. The connection hardware may include a floor rail 611, a sleeve 613, one or more screws 615, 617 and a moulding 623. These elements are illustrated in FIG. 6A and are described in detail below.

The floor rail 611 may have an "H" profile, featuring two upper extensions 619*a*, 619*b* and two lower extensions 619*c*, 619*d*. The floor rail 611 may extend along the length or width of a floor panel 602 on the interior side 644*b* of the floor panel 602. The lower extensions 619*c*, 619*d* may be disposed within the grooves 609*a*, 609*b* of the floor panel 602. The lower extensions 619*c*, 619*d* may fit loosely within the grooves 609*a*, 609*b*, allowing the gap to be filled with adhesive, thus allowing a high bond with the insulation 616*b*. The longer are the 619*a*, 619*b* extensions, the better will be the bond with the insulation 616*b*. The upper extensions 619*a*, 619*b* may protrude upward from the floor panel 602 and abut the notched edge 603 of the wall panel 604. The length of the floor rail 611, combined with the surface of the lower extension 619*a*, 619*b*, that spread the load in the foam 616*b*, may allow any load applied to the wall-to-floor joint to be distributed over a significant distance, and thereby prevent any portion of the panel from experiencing a damaging load. The floor rail 611 may include one or more pre-formed holes 612 formed through its extensions 619 to allow screws 615 to extend therethrough as described below. In some embodiments, the pre-formed holes may be formed in tight intervals to allow screws 615 to be readily inserted, regardless of any relative position of the sleeve 613 on the wall 604. The floor rail 611 may be formed from a single folded sheet of metal, such that the upper extensions 619*a*, 619*b* each comprise two layers of metal, allowing higher fastening strength for screw 615, while the lower extensions 619*c*, 619*d* each comprise a single layer of metal, which may only be required to bond to the foam 616*b*. The floor rail 611 may also be made of an aluminum extrusion or any other profile with adequate stiffness for the purpose.

The sleeve 613 may comprise an internal opening 621, which may be configured to cooperate with one or more screws 615, 617. The sleeve 613 may be disposed in the hole 607 formed in the wall panel 604, such that the sleeve 613 fits tightly in the hole 607.

As shown in FIG. 6A, one or more screws 615 may connect the floor rail 611, the sleeve 613, the wall panel 604 and the floor panel 602. A first screw 615 may extend diagonally from the internal opening 621 of the sleeve 613, through the wall panel 604, through the floor rail 611, and through the floor panel 602. A second screw 617 may extend from the floor panel 602 into the sleeve 613. Although two screws 615, 617 are illustrated in FIG. 6A, one skilled in the art may readily envision a variety of ways in which screws or other elements may be used to secure the floor rail 611 to the sleeve 613.

The wall-to-floor joint may also comprise support structures including a floor cover 625 and a wall panel corner cover 627. The floor cover 625, which may either be a thick steel sheet alone or combined with a backer as plywood or other similar material, may cover the interior side 644 of the floor panel 602 and may distribute loads that are applied to the floor panel 602. As the thickness of the floor cover 625 may vary, depending on requirements of the particular cold storage room, the upper extensions 619*a*, 619*b* of the floor rail 611 may be aligned flush with the top of the floor cover 625, as shown in FIG. 6A. The wall panel corner cover 627 may be disposed below the corner of the wall panel 604 and may cover the exposed foam layer 616*a* of the wall panel 604.

In the embodiments described above, the wall and floor panels may be held together tightly enough to form a seal therebetween which may prevent solid and liquid contaminants from becoming trapped between the wall panels. In some embodiments, the openings of the sleeves may similarly form seals to prevent solid and liquid contaminants from becoming trapped within the holes. In some embodiments, covers may be provided over the sleeves to perform this function. The moulding which may be used in the wall-to-floor joint may also form a seal over the cut portion of the wall panel. In this way, the wall-to-floor joints may be safe for use in cold storage rooms used to contain food.

The connection structures and hardware described above may form a strong joint. In particular, loads which are applied to the joint may be distributed along the width of the wall panel 604 and the length or width of the floor panel 602 proximate the joint. The floor rail 611 may distribute any applied load along its length. The sleeves 613 may distribute load along their lengths, preventing excessive load from being applied to any single area of the interior foam layers 616*a*, 616*b*. This may prevent the foam from being crushed. One or more screws 615, 617 may pull the floor rail 611 and the floor panel 602 tightly against the wall panel 604, thereby making the joint both airtight and mechanically solid. These features may increase the force which the corner-to-corner joint is capable of withstanding without experiencing damage.

Further, in the wall-to-floor joint described above, the panels may be held together by metal-to-metal junctions between the connection hardware and the metal plates of the panels. Specifically, screws used in the joint may have more than one point of contact with metal components. In comparison, prior art panels included connection hardware which was only anchored in the foam layer of the panels. This hardware could damage the foam when connections were formed or when loads were applied to the connections. The present disclosure avoids these shortcomings and provides strong joints, which may in turn provide for a long-lasting structure.

One skilled in the art will recognize that the wall-to-floor joints described above may be used to join panels in applications other than cold storage rooms. For example, such joints may be used to connect siding panels or panels used in temporary housing.

Floor-to-Floor Joints

Figure 7A:
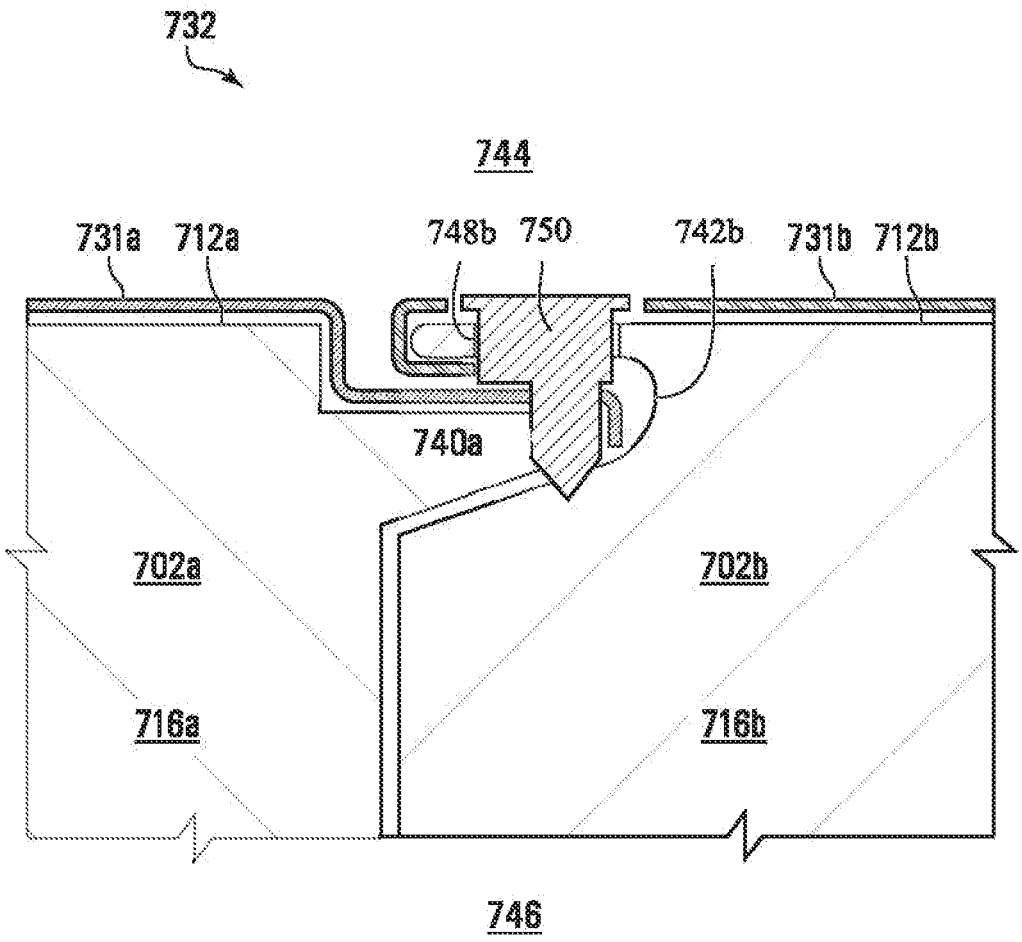
FIGS. 7A-7C are a floor-to-floor joint in accordance with the present disclosure.
Figure 7B:
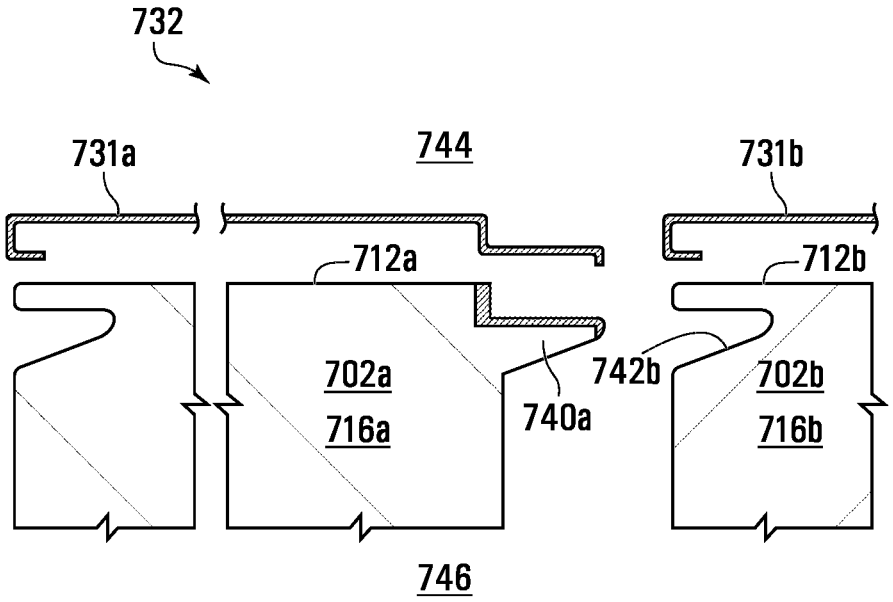
Figure 7C:
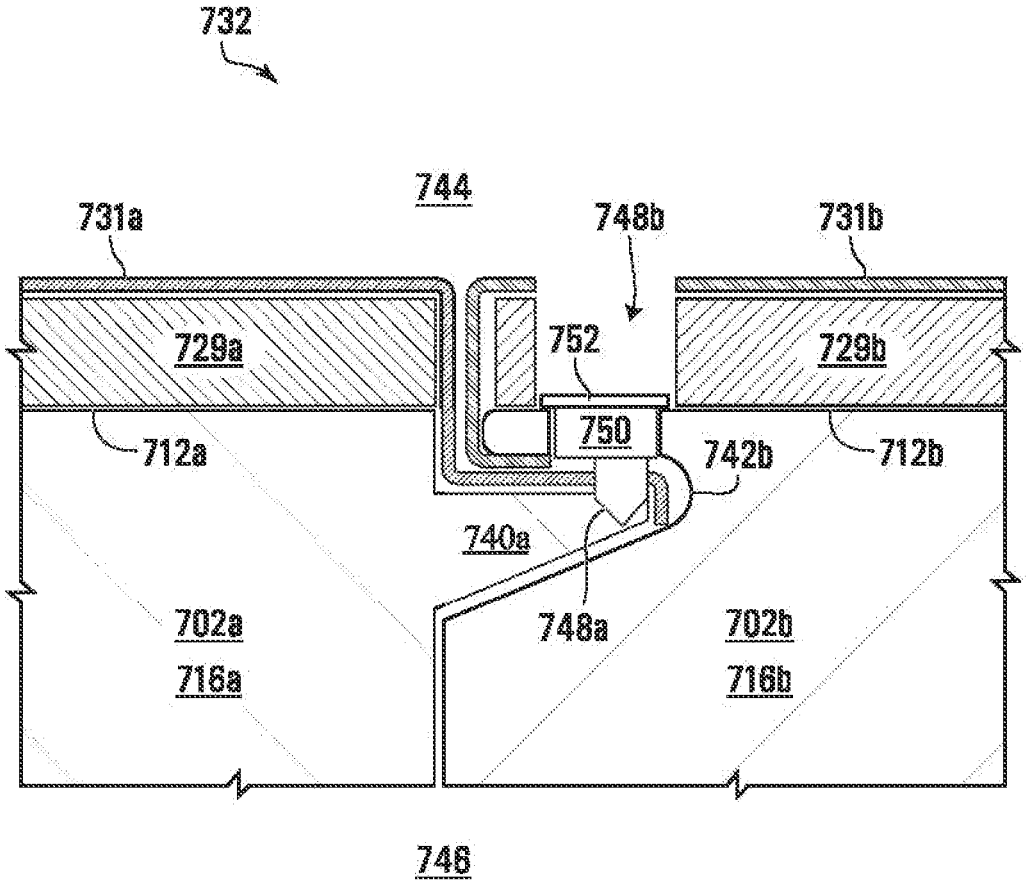

Adjacent floor panels may be connected to each other at a floor-to-floor joint. FIGS. 7A-7C illustrate a floor-to-floor joint connecting a first floor panel 702*a* and a second floor panel 702*b*. The floor panels 702*a*, 702*b* may abut each other within a floor 732 of a cold storage room. The floor 732 may have an interior side 744 and an exterior side 746.

Each of the floor panels 702*a*, 702*b* may be made up of an interior metal sheet 712*a*, 712*b*, an exterior metal sheet (not illustrated), and a layer of foam 716*a*, 716*b* disposed between the metal sheets. Each of the floor panels 702*a*, 702*b* may include alignment structures. As illustrated, the first floor panel 702*a* may include a tongue 740*a* proximate the interior side 744. The first floor panel 702*a* may include a groove (not illustrated) proximate the exterior side 746. The second floor panel 702*b* may include a tongue (not illustrated) and a groove 742*b* complementary to those of the first floor panel 702*a*. In other embodiments, the panels 702*a*, 702*b* may include no alignment structures, or may include different alignment structures.

In some embodiments, the floor panels 702*a*, 702*b* may be covered by a protective covering 731*a*, 731*b*. As shown in FIGS. 7A-7C, the protective coverings 731*a*, 731*b* may fit over the floor panels 702*a*, 702*b* and may extend into the alignment structures. In this way, the floor panels 702*a*, 702*b* may be completely sealed, and solid or liquid contaminants may be prevented from entering gaps between the floor panels 702*a*, 702*b*.

In some embodiments, the floor panels 702*a*, 702*b* may be covered by load distributing features. As shown in FIG. 7C, these features may feature rigid panels 729*a*, 729*b*. The rigid panels 729*a*, 729*b* may be disposed between the interior metal sheets 712*a*, 712*b* of the floor panels 702*a*, 702*b* and the protective coverings 731*a*, 731*b*. The edges of the rigid panels 729*a*, 729*b* may be covered by the protective coverings 731*a*, 731*b* as illustrated. In some embodiments, the rigid panels 729*a*, 729*b* may be made of plywood. The rigid panels 729*a*, 729*b* may distribute loads applied thereon over a wide area of the floor panels 702*a*, 702*b*, and may thereby prevent a damaging load from being applied to any one area.

The floor panels 702*a*, 702*b* may have connection structures formed thereon. As shown in FIG. 7A, the connection structures may comprise a first hole 748*a* formed in the interior side 744 of the first floor panel 702*a* and a second hole 748*b* formed in the interior side 744 of the second wall panel 702*b*. The first hole 748*a* may extend through the tongue 740*a*. The second hole 748*b* may extend through the portion of the second floor panel 702*b* interior to the groove 742*b* and may or may not extend through any portion of the second floor panel 702*b* exterior to the groove 742*b*. As shown in FIG. 7C, the holes 748*a*, 748*b* may extend through the rigid panels 729*a*, 729*b* and protective coverings 731*a*, 731*b*. One or more first holes 748*a* and one or more second holes 748*b* may be formed along the length of the floor panels 702*a*, 702*b* proximate the joint.

The holes 748*a*, 748*b* may be formed by drilling into the interior side 744 of the floor panels 702*a*, 702*b* that have been manufactured as described above. If rigid panels 729*a*, 729*b* and protective coverings 731*a*, 731*b* are used, the holes 748*a*, 748*b* may be formed by drilling through these elements as well. The holes 748*a*, 748*b* may be formed as part of the manufacturing process or may be formed during later modification of the floor panels 702*a*, 702*b*. In some embodiments, the holes 748*a*, 748*b* may be formed by machining, or by any process of material removal known in the art.

Connection hardware may be used in conjunction with the connection structures to lock the wall panels 702*a*, 702*b* together. As shown in FIGS. 7A-7C, the connection hardware may comprise a cam 750. The cam 750 used in the floor-to-floor joint may be similar to the cam 250 used in the wall-to-wall joint, which is described above.

The cam 750 may comprise a flange 752, whose diameter may be larger than the portion of the holes 748*a*, 748*b*, formed in the panels 702*a*, 702*b*, but smaller than the portion of the holes 748*a*, 748*b* formed in the protective coverings 731*a*, 731*b* and the rigid panels 729*a*, 729*b*. The flange 752 may remain interior to the floor panels 702*a*, 702*b*, but exterior to the protective coverings 731*a*, 731*b* and the rigid panels 729*a*, 729*b* when the cam 750 is inserted into the holes 748*a*, 748*b*. Rotating the cam 750 within the holes 748*a*, 748*b* may lock/unlock the floor panels 702*a*, 702*b* to each other.

In the floor-to-floor joints described above, the floor panels may be held together tightly enough to form a seal therebetween which may prevent solid and liquid contaminants from becoming trapped between the wall panels. In some embodiments, the caps of the cams may similarly form seals to prevent solid and liquid contaminants from becoming trapped within the holes. In some embodiments, covers may be provided over the caps of the cams to perform this function. In this way, the floor-to-floor joint may be safe for use in cold storage rooms used to contain food.

One skilled in the art will recognize that the floor-to-floor joints described above may be used to join panels in applications other than cold storage rooms. For example, such joints may be used to connect siding panels or panels used in temporary housing.

Custom Panels

In some embodiments, it may be desired to connect wall panels as described above to one or more custom molded panels. For example, a custom molded doorframe panel with a custom molded door may be included as part of a cold storage room. For another example, curved custom molded panels may be used to provide different structure geometries.

Figure 8A:
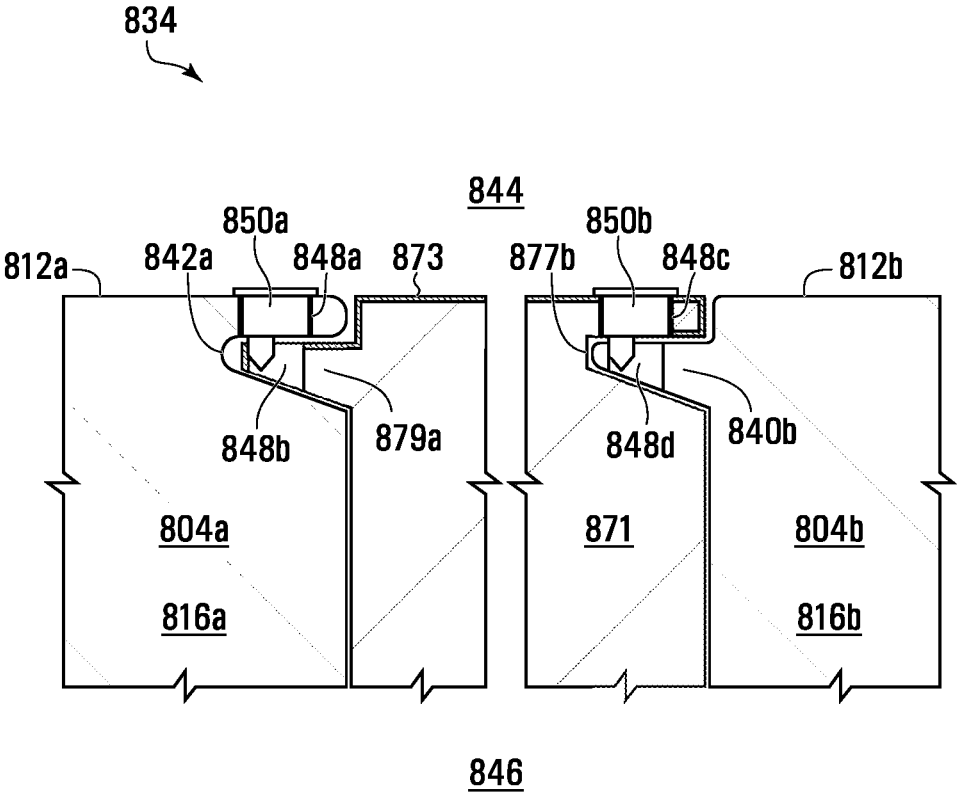
FIGS. 8A-8B are a wall-to-custom panel joint in accordance with the present disclosure.
Figure 8B:
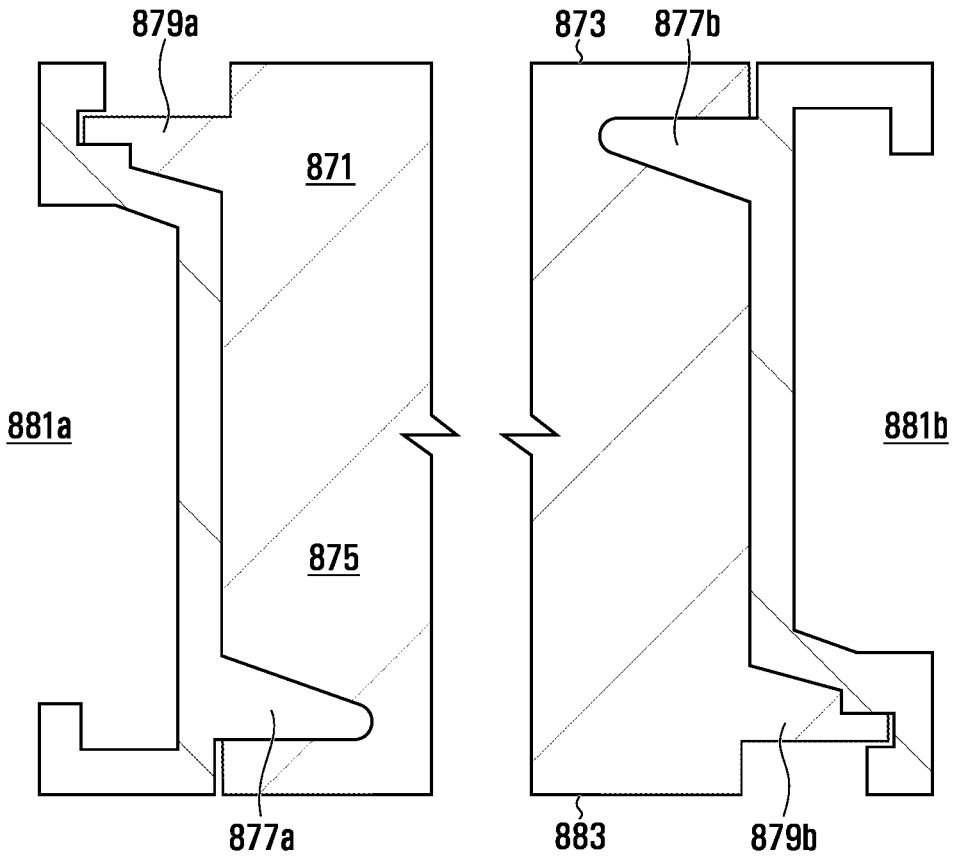

FIGS. 8A-8B illustrate a custom panel 871. FIG. 8A illustrates the connection of a custom panel 871 to two wall panels 804*a*, 804*b*. The panels 804*a*, 804*b*, 871 may abut each other along a single wall 834 of a cold storage room. The wall 834 may have an interior side 844 and an exterior side 846. With reference to FIG. 8A, the wall 834 may extend in either a length direction or a width direction.

Each of the wall panels 804*a*, 804*b* may be made up of an interior metal sheet 812*a*, 812*b*, an exterior metal sheet (not illustrated), and a layer of foam 816*a*, 816*b* disposed between the metal sheets. Each of the wall panels 804*a*, 804*b* may include alignment structures. As illustrated, the first wall panel 804*a* may include a groove 842*a* proximate the interior side 844 of the wall 834 and a tongue (not illustrated) proximate the exterior side 846 of the wall 834. The second wall panel 804*b* may include a tongue 840*b* and a groove (not illustrated).

The custom panel 871 may be made up of an interior metal sheet 873, an exterior metal sheet 883 and a layer of foam 875 disposed between the metal sheets 873, 883. The custom panel 871 may include alignment structures. Specifically, the custom panel 871 may include a tongue 879*a* and a groove 877*a* complementary to the first wall panel 804*a* and a groove 877*b* and a tongue 879*b* complementary to the second wall panel.

The custom panel 871 may be made by custom molding. FIG. 8B illustrates a mold 881 used to form the custom panel 871. The mold 881 may comprise two pieces 881*a*, 881*b*, such that each piece shapes one side of the custom panel 871. The mold 881 may form the foam layer 875 to include the alignment structures described above. The metal sheets 873, 883 may be folded within the mold, such that they cover a portion of the alignment structures as shown in FIG. 8B.

The panels 804*a*, 804*b*, 871 may have connection structures formed thereon. As shown in FIG. 8A, the connection structure connecting the first wall panel 804*a* and the custom panel 871 may comprise a first hole 848*a* formed in the interior side 844 of the first wall panel 804*a* and a second hole 848*b* formed in the interior side 844 of the custom panel 871. The first hole 848*a* may extend through the portion of the first wall panel 804*a* interior to the groove 842*a* and may or may not extend through any portion of the first wall panel 804*a* exterior to the groove 842*a*. The second hole 848*b* may extend through the tongue 879*a*. One or more first holes 848*a* and one or more second holes 848*b* may be formed along the length of the panels 804*a*, 871 proximate the joint. The connection structure connecting the second wall panel 804*b* and the custom panel 871 may comprise a third hole 848*c* and a fourth hole 848*d*, as shown in FIG. 8A.

The holes 848*a*-848*d* may be formed by drilling into the interior side 244 of the panels 804*a*, 804*b*, 871 that have been manufactured as described above. The holes 848*a*-848*d* may be formed as part of the continuous and/or custom manufacturing process or may be formed during later modification of the wall panels 804*a*, 804*b* and/or the custom panel 871. In some embodiments, the holes 848*a*-848*d* may be formed by machining, or by any process of material removal known in the art.

Connection hardware may be used in conjunction with the connection structures to lock the panels 804*a*, 804*b*, 871 together. As shown in FIG. 8A, the connection hardware may comprise a cam 850*a*, 850*b* disposed in each pair of holes 848*a*-848*d*. The cams 850*a*, 850*b* may have a similar structure and function as the cam 250 described above in the description of FIGS. 2A-2C. The connection hardware may comprise any hardware known in the art and may include off-the-shelf components and/or custom-made components. The components may be made of aluminum, another metal, or any other rigid material with sufficient strength.

Although the connection hardware and connection structures have been described as being formed on the interior side of the panels, one may readily envision that they may be formed on the exterior side of the panels, or on both sides. Such embodiments may provide greater stability in a structure constructed from the wall panels and may provide greater flexibility in the manner in which such a structure may be assembled.

One may note that the illustration and description here relates to connecting a custom panel at an in-line wall-to-wall joint. Custom panels may similarly be joined to wall panels, ceiling panels, and floor panels at any other type of joint described in the present disclosure. One may readily envision that custom panels could be formed to include the necessary alignment structures, connection structures, and connection hardware to form such connections. The alignment structures, connection structures, and connection hardware may or may not differ from the analogous structures and hardware that have been described above for standard wall panels, ceiling panels, and floor panels.

Kit for a Cold Storage Room

Some embodiments of the present disclosure relate to a kit for assembling a cold storage room and a method of manufacturing such a kit. A kit according to the present disclosure may be provided to an individual who wishes to assemble a cold storage room to allow for easy installation of the cold storage room. The cold storage room which would be assembled from the kit may have some or all of the features described above.

Figure 9:
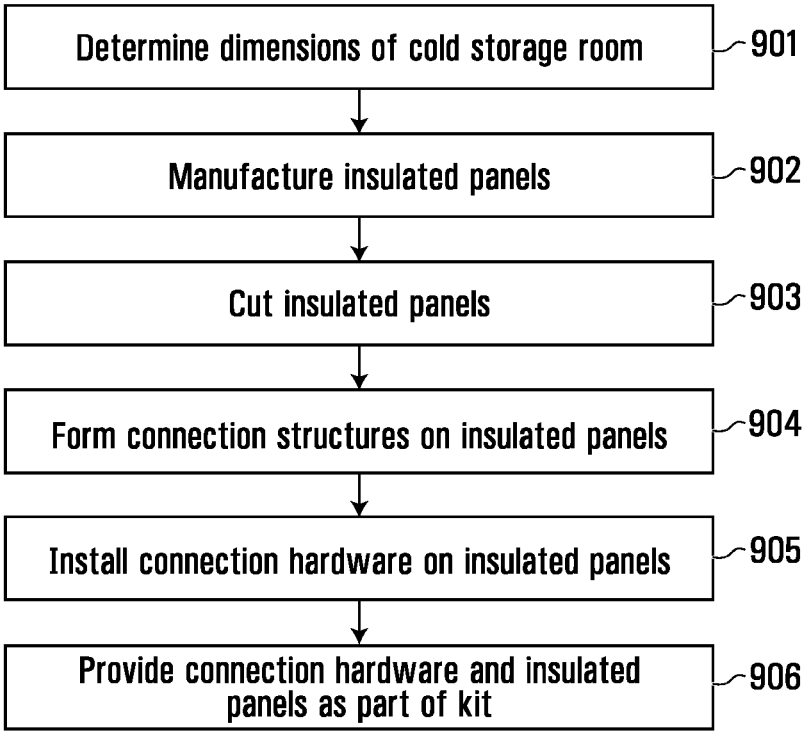
FIG. 9 is a flowchart of a method of manufacturing a kit for a cold storage room according to the present disclosure.

FIG. 9 shows a flowchart outlining the steps of a method of manufacturing a kit for constructing a cold storage room. Although the steps are illustrated in a particular order in FIG. 9, one skilled in the art will recognize that the order of steps may be rearranged without departing from the scope of the present disclosure.

As shown in block 901, the dimensions of the cold storage room which an individual wishes to construct may be determined. As described above, these dimensions may be determined based on the interior dimensions of a structure in which the cold storage room may be housed. In some embodiments, a client may simply provide a desired set of dimensions to a manufacturer. These dimensions may be used to determine the number of insulated panels to manufacture.

As shown in block 902, insulated panels may be manufactured. The insulated panels may be manufactured following the automated process described above. During manufacture, the insulated panels may be cut to a desired length based on the dimensions of the cold storage room determined in step 901. The length of each insulated panel cut may vary based on whether the insulated panel will be used as a floor panel, a wall panel, or a ceiling panel. Manufacturing the insulated panels may also include forming alignment structures as described above.

As shown in block 903, the edges of the insulated panels may be cut. The width at which the insulated panels are cut may be determined based on the dimensions of the cold storage room as described above. In some embodiments, a single insulated panel may be cut to form two end panels for a wall, floor, or ceiling. The profile of the cut(s) made on each insulated panel may be determined based on the placement of the insulated panel within the cold storage room and on the joints which the insulated panel is expected to form. Potential cut profiles are detailed above under the description of each joint type. In some embodiments, the edges of the insulated panels may be cut before the insulated panels are cut to a desired length, such that the order of steps 902 and 903 are reversed.

As shown in block 904, connection structures may be formed on the panels. The connection structures formed on each panel may be determined based on the type(s) of joint(s) which each insulated panel is intended to make. Specific connection structures for forming each joint are detailed above under the description of each joint type. Forming connection structures may comprise cutting, drilling, machining, or otherwise removing material from the insulation panels.

In general, step 902 may be considered the manufacture of insulated panels and steps 903-904 may be considered the modification of insulated panels. In some embodiments, the manufacture and modification may be performed together—i.e. by a single manufacturer, at a single facility, and/or as part of a single process. In some embodiments, the manufacture and modification may be performed separately—i.e. by different manufacturers, at different facilities, and/or as part of different processes.

As shown in block 905, connection hardware may be installed on the panels. Specific connection hardware for forming each type of joint is detailed above under the description of each joint type. For each joint, the connection hardware which can be installed on the panels without making up the joint may be installed in this step. Connection hardware which cannot be installed on the panels without making up the joint may not be installed in this step.

As shown in block 906, connection hardware may be provided with the panels. As discussed above, some connection hardware cannot be installed on the insulated panels without making up the joints. This hardware may not be installed during the manufacture of a kit. Rather, it may be provided as part of a kit, so that the client/end user may use it to assemble the cold storage room.

Based on this method, a kit may be provided to a client/end user for the construction of a cold storage room of a particular size and shape. The kit may comprise insulated panels cut to a necessary size based on the cold storage room. The insulated panels may have alignment structures and connection structures formed thereon. In some embodiments, connection hardware may be installed on the insulated panels. Additional connection hardware may be provided as part of the kit, but may not be installed on the insulated panels. In some embodiments, none of the connection hardware may be installed on the insulated panels. Instructions for installation of the cold storage room may also be provided with the kit.

A cold storage room may be readily assembled by skilled or unskilled workers using a kit as disclosed herein. The joints between the panels of the cold storage room may be assembled by simply aligning the panels, and securing the cams and screws as described above. Accordingly, this kit may provide a cold storage room that may be cheaply and quickly installed, while still providing high quality insulation and safe surfaces for use with food.

Advantages

Advantages of the cold storage room, associated kit and methods, and joints disclosed herein have been discussed throughout. Some advantages are further outlined here. A cold storage room according to the present disclosure may have several advantages over the prior art. The interior of a cold storage room may be completely sealed, such that it may be readily wiped clean and is sanitary for use in food storage. The complete seals may also enhance the insulation provided by the cold storage room. The insulation may be further enhanced because the cold storage room comprises continuously-manufactured panels, which may provide increased and/or more even insulation compared to custom molded panels.

A kit for assembling a cold storage room according to the present disclosure may have several advantages over the prior art. The kit may provide a cold storage room having the advantages described above. The kit may also be faster and easier to install, and may allow for installation by specialized or general workers. This may decrease the cost of installing the cold storage room. The kit may also include panels having alignment structures, which may make aligning the panels during assembly easier, and may thereby decrease the number of workers needed to install the cold storage room.

Methods of manufacture of a kit for assembling a cold storage room according to the present disclosure may have several advantages over the prior art. The method may include manufacturing continuous panels, rather than custom-made panels. This may decrease the time and cost required to perform the method, thereby allowing more kits to be manufactured. The method may also require making simple modifications to the insulated panels after they have been manufactured, rather than installing connection hardware in the panels during the manufacture process. This may allow the manufacturing process and the modification process to be separated in time, space, and/or actor as described above, thereby providing significant flexibility to the methods disclosed herein.

The joints disclosed herein may have advantages over similar prior art joints. They may be quicker to make up, allowing for easy installation of any structure in which they are included. They may also be robust to loads applied to the panels which they connect. The joints may also be easier to manufacture than prior art joints having similar strength, making them more cost efficient.

What is claimed is:

1. A method of manufacturing a kit for an insulated panel structure, the method comprising:

determining one or more dimensions of the insulated panel structure;

providing continuously manufactured insulation panels, comprising an interior metal sheet, an exterior metal sheet, and a rigid foam layer disposed between said interior metal sheet and said exterior metal sheet, that are cut to have a length based on the dimensions of the insulated panel structure, and having side ends with tongue and groove alignment structures formed thereon;

cutting some of the continuously manufactured insulation panels to have a width based on the dimensions of the insulated panel structure and to form one or more joints between cut sides of the continuously manufactured insulation panels;

forming connecting structures on two or more of said insulation panels for said insulated panel structure, the connecting structures configured to form one or more joints between adjoined side ends, said connecting structures including opposed holes in said interior metal sheet and said exterior metal sheet; and providing connection hardware configured to mate with the connecting structures and for forming one or more joints between uncut sides of the continuously manufactured insulation panels, said connection hardware including:

a rotatable shaft;

two shaft-heads couplable to respective ends of said rotatable shaft for fitting into said opposed holes; and a locking-arm for fitting on said rotatable shaft and lockable to a complementary structure of another one of said insulation panels.

2. The method of claim 1, further comprising: modifying one or more of the provided continuously manufactured insulation panels to be a floor panel, modifying one or more of the provided continuously manufactured insulation panels to be a wall panel, and modifying one or more of the provided continuously manufactured insulation panels to be a ceiling panel.

3. The method of claim 1, comprising forming a wall-to-ceiling joint between two of said continuously manufactured insulated panels modified to be a wall panel and a ceiling panel.

4. The method of claim 3, further comprising:

forming a top edge of the wall panel to form a notched edge; and forming an edge of the ceiling panel to form an angled edge corresponding to the notched edge.

5. The method of claim 1, further comprising modifying at least one of said continuously manufactured insulated panels to be a floor panel and providing a protective covering and a rigid panel configured to be disposed over each floor panel.

6. The method of claim 1, further comprising forming a wall-to-floor joint between two of said continuously manufactured insulated panels modified to be a wall panel and a floor panel.

7. The method of claim 6, further comprising:

forming a bottom edge of the wall panel to form a notched edge; and forming an edge of the floor panel to form an angled edge corresponding to the notched edge.

8. The method of claim 7, further comprising:

forming a hole in an interior side of the wall panel proximate the notched edge; and forming two grooves in an interior side of the floor panel proximate the angled edge.

9. The method of claim 8, further comprising providing the following components:

a floor rail disposed in the two grooves;

an alignment moulding attached to the wall panel;

a wall sleeve disposed in the hole; and an second screw configured to extend from the wall sleeve through the floor rail.

10. The method of claim 1, further comprising installing the connection hardware on one or more of the insulated panels.

11. The method as defined in claim 10, wherein said installing comprises:

inserting, concentrically to said opposed holes, said rotatable shaft in said foam layer through an opening of any one of said opposed holes;

inserting one of said two shaft-heads in each of said opposed holes;

coupling said shaft-heads to said rotatable shaft; and coupling said locking-arm so that said locking-arm extends outwardly from a corresponding one of said uncut sides when in a locked position, thereby allowing said locking-arm to lock with said complementary structure.

12. The method as defined in claim 1, wherein said complementary structure is one of said connection hardware.

13. The method as defined in claim 12, wherein said locking-arm of said connection hardware is lockable to a locking-arm or a portion of a rotatable shaft of another one of said connection hardware.

14. A method of manufacturing a kit for an insulated panel structure, the method comprising:

determining one or more dimensions of the insulated panel structure;

providing continuously manufactured insulation panels, cut to have a length based on the dimensions of the insulated panel structure, and having alignment structures formed thereon;

cutting one or more of the continuously manufactured insulation panels to have a width based on the dimensions of the insulated panel structure and to form one or more joints; and wherein insulated panels for said insulated panel structure are provided;

forming one or more connecting structures on one or more of said insulation panels for said insulated panel structure, the one or more connecting structures configured to form one or more joints;

providing connection hardware configured to mate with the one or more connecting structures and to form one or more joints; and forming a corner wall-to-wall joint between two of said continuously manufactured insulation panels modified to be a first wall panel and a second wall panel;

wherein forming the one or more of the connecting structures comprises:

cutting an edge of the first wall panel at a forty-five degree angle to form a first angled edge;

cutting an edge of the second wall panel at a forty-five degree angle to form a second angled edge;

forming a first hole in an interior side of the first wall panel proximate the first angled edge;

forming a second hole in an interior side of the second wall panel proximate the second angled edge;

forming a first notch and a first groove in an exterior side of the first wall panel proximate the first angled edge; and forming a second notch and a second groove in an exterior side of the second wall panel proximate the second angled edge.

15. A method of manufacturing a kit for an insulated panel structure, the method comprising:

determining one or more dimensions of the insulated panel structure;

providing continuously manufactured insulation panels, cut to have a length based on the dimensions of the insulated panel structure, and having alignment structures formed thereon;

cutting one or more of the continuously manufactured insulation panels to have a width based on the dimensions of the insulated panel structure and to form one or more joints; and wherein insulated panels for said insulated panel structure are provided;

forming one or more connecting structures on one or more of said insulation panels for said insulated panel structure, the one or more connecting structures configured to form one or more joints;

providing connection hardware configured to mate with the one or more connecting structures and to form one or more joints;

forming a top edge of a wall panel to form a notched edge; and forming an edge of a ceiling panel to form an angled edge corresponding to the notched edge;

wherein forming the one or more connecting structures comprises:

forming a hole in an interior side of the wall panel proximate the notched edge; and forming two grooves in an interior side of the ceiling panel proximate the angled edge.

16. The method of claim 15, wherein providing the connection hardware comprises providing the following components:

a ceiling rail disposed in the two grooves;

an alignment moulding attached to the wall panel;

a wall sleeve disposed in the hole;

a first screw configured to extend from the ceiling rail through the wall sleeve; and a second screw configured to extend from the wall sleeve through the ceiling rail.

* * * * *